US005991563A

United States Patent [19]

Haneda et al.

[11] Patent Number: 5,991,563

[45] Date of Patent: Nov. 23, 1999

[54] IMAGE FORMING APPARATUS

[75] Inventors: Satoshi Haneda; Kunio Shigeta; Yotaro Sato; Hisayoshi Nagase, all of Hachioji, Japan

[73] Assignee: Konica Corporation, Tokyo, Japan

[21] Appl. No.: 09/123,215

[22] Filed: Jul. 27, 1998

[30] Foreign Application Priority Data

Aug. 6, 1997 [JP] Japan ..... 9-211931
Aug. 20, 1997 [JP] Japan ..... 9-223557

[51] Int. Cl.[6] ..... G03G 15/20

[52] U.S. Cl. ..... 399/68; 399/45; 399/67; 399/69; 399/309; 399/400

[58] Field of Search ..... 399/43, 44, 45, 399/67, 68, 69, 400, 401, 302, 306, 308, 309

[56] References Cited

U.S. PATENT DOCUMENTS

| | | | |
|---|---|---|---|
| 4,634,262 | 1/1987 | Imaizumi et al. | 399/45 |
| 4,719,489 | 1/1988 | Ohkubo et al. | 399/45 |
| 5,027,159 | 6/1991 | Oda et al. | 399/309 |
| 5,159,392 | 10/1992 | Kasahara et al. | 399/309 |
| 5,289,247 | 2/1994 | Takano et al. | 399/68 |
| 5,552,874 | 9/1996 | Ohtsuka et al. | 399/335 |
| 5,621,511 | 4/1997 | Nakayama | 399/69 X |
| 5,799,226 | 8/1998 | Shigeta et al. | 399/309 X |
| 5,826,143 | 10/1998 | Haneda et al. | 399/309 X |
| 5,875,372 | 2/1999 | Sato et al. | 399/67 |

FOREIGN PATENT DOCUMENTS

| | | |
|---|---|---|
| 49-37538 | 10/1974 | Japan . |
| 54-28740 | 9/1979 | Japan . |
| 63-008779 | 1/1988 | Japan . |
| 63-149684 | 6/1988 | Japan . |
| 63-184777 | 7/1988 | Japan . |
| 64-44457 | 2/1989 | Japan . |
| 3-010264 | 1/1991 | Japan . |
| 3-163464 | 7/1991 | Japan . |
| 4-214576 | 8/1992 | Japan . |
| 5-006043 | 1/1993 | Japan . |
| 5-006045 | 1/1993 | Japan . |
| 7-092850 | 4/1995 | Japan . |
| 8-220928 | 8/1996 | Japan . |

*Primary Examiner*—Matthew S. Smith
*Attorney, Agent, or Firm*—Frishauf, holtz, Goodman, Langer & Chick, P.C.

[57] ABSTRACT

In an image forming apparatus provided with an image carrying member, a toner image forming device, an intermediate image carrying member, a first transfer member, and a second transfer member, toner images are formed on both sides of a sheet. The toner images on the both sides of the sheet is fixed by a fixing device having a heater and a pair of fixing rollers. A detecting device detects at least one of a temperature of the fixing members, a material of the sheet and a size of the sheet, and a controller changes an image forming interval in accordance with at least one of the temperature of the fixing members, the material of the sheet and the size of the sheet detected by the detecting device.

12 Claims, 12 Drawing Sheets

IMAGE FORMING APPARATUS

BACKGROUND OF THE INVENTION

The present invention relates to an image forming apparatus conducting image forming through an electrophotographic system, and in particular, to an image forming apparatus wherein double-sided image forming is conducted by forming toner images on both sides of a transfer material and by heat-fixing them collectively.

Heretofore, for double-sided copying to form toner images on both sides of a transfer material, there has been employed a method wherein an image on one side which is formed on an image forming body is transferred and fixed on a transfer material, then the transfer material is stored temporarily in a double-side reversing and sheet-feeding device, and then the transfer material is fed out of the double-side reversing and sheet-feeding device in synchronization with an image formed on the image forming body successively so that the image on the other side is transferred and fixed on the transfer material.

In the double-sided copying apparatus of this kind, a transfer material needs to be fed to a double-side reversing and sheet-feeding device and needs to be conveyed to pass through a fixing device twice, as stated above, resulting in a longer conveyance distance for the transfer material and resulting in longer processing time for copying. Further, reliability in conveyance of a transfer material is low, causing a jam, because the transfer material which tends to be curled after passing through the fixing device is fed again.

In opposition to the foregoing, TOKKOSHO Nos. 49-37538, 54-28740, TOKKAIHEI Nos. 1-44457 and 4-214576 disclose those wherein toner images are formed on both sides of a transfer material to be fixed collectively.

However, it is not easy to conduct fixing collectively for the transfer material having on its both sides toner images. To conduct fixing collectively for the transfer material having on its both sides toner images, it is necessary to provide heating means on both sides of the transfer material, which inevitably results in big power consumption in a fixing means because power is supplied to both heating means. Further, in this method, an interval for conveying a transfer material to a fixing device in the case of single-sided copying is different from that in the case of double-sided copying, and therefore, fixing failure or waste of electric power is caused in the conventional fixing device.

The first object of the invention is to solve the above-mentioned problems and to provide an image forming apparatus wherein excellent fixing can be conducted with less power consumption even when a transfer material having toner images on its both sides is collectively fixed and when a transfer material having a toner image on its one side is fixed, without reducing the number of transfer materials to be processed.

Inventors of the invention have studied color image forming on both sides of a transfer material and on one side only of a transfer material, by making an image forming apparatus wherein a plurality of toner image forming means each being composed of a charging means, an imagewise exposure means and a developing means are arranged around the first image carrying means, the second image carrying means is provided against the first image carrying means, then superposed color toner images representing a reverse side image are formed on the first image carrying means and these color toner images are collectively transferred onto the second image carrying means temporarily, then superposed color toner images representing an obverse side image are formed on the first image carrying means, and after transferring the toner images on the first image carrying means onto the obverse side of the transfer material and transferring the toner images on the second image carrying means onto the reverse side of the transfer material, toner images on the transfer material are fixed to form a double-sided color image.

In the aforesaid image forming apparatus and the image forming method, image forming timing and transfer material supplying timing are controlled so that toner images representing a reverse side image held on the second image carrying means and toner images representing an obverse side image held on the first image carrying means may be synchronized with a transfer material in the transfer area, for the purpose of aligning the leading edge of the obverse side image and that of the reverse side image on the transfer material. Namely, when forming images on both sides of a transfer material, a time interval from the start of forming a reverse side toner image to the start of forming an obverse side toner image is made to agree with the rotation cycle of the second image carrying means regardless of a size of an image and of a length of a transfer material in the conveyance direction therefor, and supply timing for the transfer material is controlled in synchronization with timing for forming the obverse side toner image. For the reason of easy control of timing, even in the case of continuous image forming on only one side of a transfer material, a time interval from the start of toner image formation or the start for supplying a transfer material to the succeeding start of toner image formation or the succeeding start for supplying a transfer material is made to agree with the rotation cycle of the second image carrying means. Further, when forming images continuously on both sides of a transfer material, a time interval from the start of forming an obverse side toner image to the start of forming a reverse side toner image is also made to agree with the rotation cycle of the second image carrying means. Furthermore, even in the case of forming images continuously on both sides of a transfer material while making the second image carrying means to carry thereon toner images equivalent to plural sheets of the transfer material, an interval of forming toner images is determined based on the rotation cycle of the second image carrying means so that intervals for forming reverse side toner images or obverse side toner images which are formed continuously may be equal.

However, in the case of forming images continuously only on one side of a transfer material, if a time interval is made to agree with the rotation cycle of the second image carrying means when the restriction of control of timing for an image forming process or for supplying a transfer material is only way for the time interval for toner image forming or for transfer material supply, the number of sheets for image formation per unit time is reduced. When forming images continuously on both sides of a transfer material, if the time interval from the start of forming an obverse side toner image to the start of forming a succeeding reverse side toner image is made to agree with the rotation cycle of the second image carrying means, the number of sheets for image formation per unit time is also reduced in this case. Furthermore, even in the case of forming images continuously on both sides of a transfer material while making the second image carrying means to carry thereon toner images equivalent to plural sheets of the transfer material, if the interval of forming toner images is determined to be the same as the rotation cycle of the second image carrying means when the restriction of timing control for the image forming process or for supply of transfer materials is the only way for the forming interval for reverse side toner images or obverse side toner images to be formed continuously, the number of sheets for image forming per unit time is also reduced in this case.

The invention has been achieved in view of the technical problems stated above, and its second object is to provide image forming apparatuses in the following items 2-1–2-3.

2-1

An image forming apparatus wherein it is possible to improve the image forming speed in the case of forming images continuously on one side of a transfer material.

2-2

An image forming apparatus wherein it is possible to improve the image forming speed in the case of forming images continuously on both sides of a transfer material.

2-3

An image forming apparatus wherein it is possible to improve the image forming speed in the case of forming images continuously on both sides of a transfer material, while making the second image carrying means to carry toner images equivalent to plural sheets of transfer material.

SUMMARY OF THE INVENTION

The first object of the invention can be attained by the structures shown below. An apparatus for forming an image, comprises:

an image carrying member;

toner image forming means for forming toner images on the image carrying member;

an intermediate image carrying member onto which the toner image is transferred from the image carrying member;

a first transfer member for transferring the toner image from the first image carrying member to the intermediate image carrying member or to a first side of a sheet;

a second transfer member for transferring the toner image from the intermediate image carrying member to a second side of the sheet;

fixing means having a heater and a pair of rotatable fixing members between which the sheet is nipped and heated so that the toner images on the first and second sides of the sheet are fixed;

detecting means for detecting at least one of a temperature of the fixing members, a material of the sheet and a size of the sheet, and control means for changing an image forming interval in accordance with at least one of the temperature of the fixing members, the material of the sheet and the size of the sheet detected by the detecting means.

DETAILED DESCRIPTION OF THE PREFERRED EMBODIMENT

Prior to explanation of each invention, there will be explained an embodiment common to image forming apparatuses to which each invention is applied and in which toner images are formed on both sides and are fixed collectively. Incidentally, the invention is not limited to the embodiment described below. Further, the technical scope of the claims and the meaning of terminologies are not limited by the description in the following column. In the explanation of the following embodiment, an image to be transferred, in case of transfer of a color toner image onto a transfer material, onto the surface of the transfer material on the side to face an image forming body in a transfer area is called an obverse side image, while an image to be transferred onto the other side of the transfer material is called a reverse side image. Though the embodiment explained below are all for the image forming apparatus to form a color image, the invention can also be applied to a monochromatic image forming apparatus.

Figure 1:
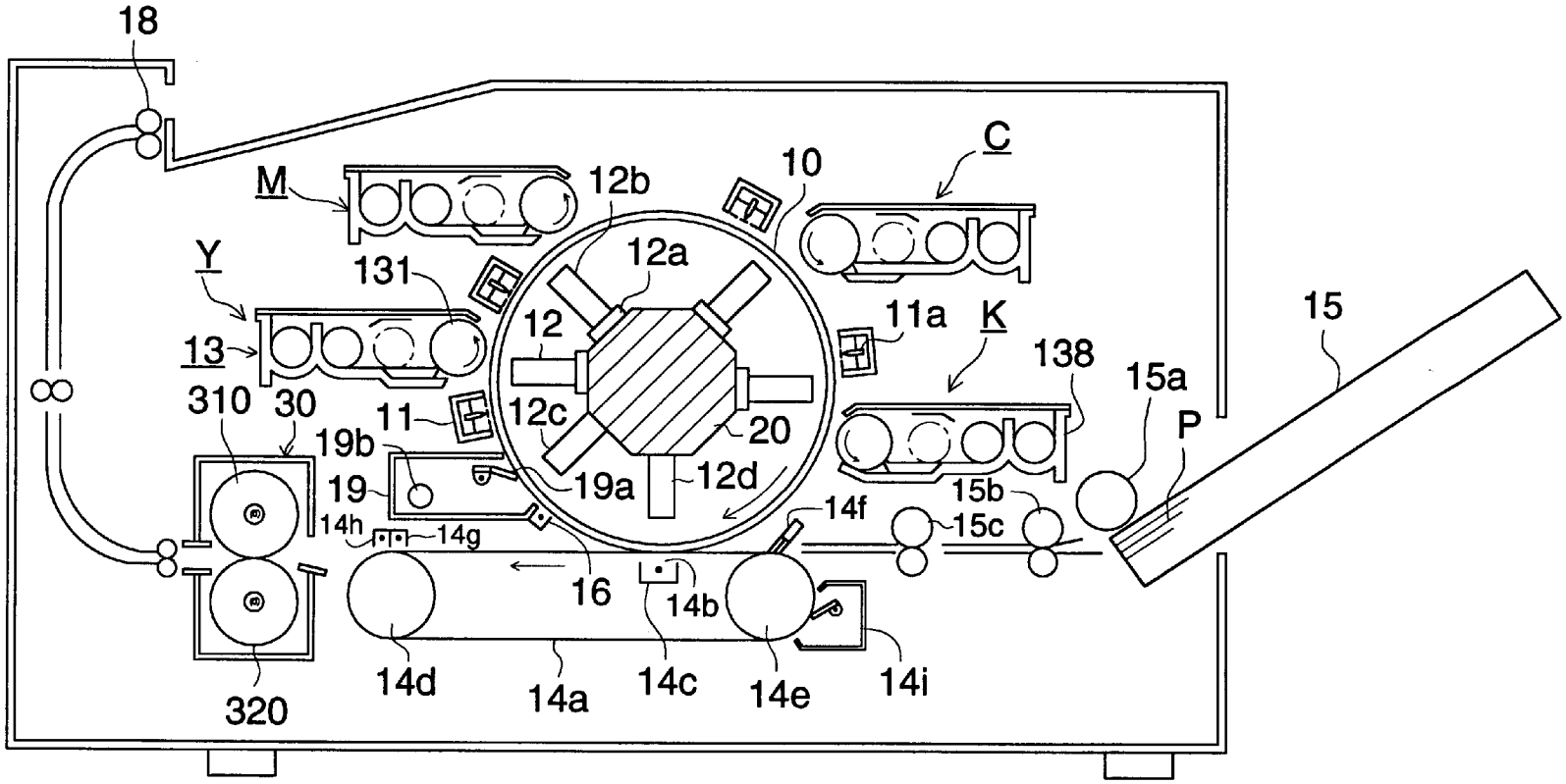
FIG. 1 is a sectional structural diagram showing an example of an embodiment of an image forming apparatus in the invention.

Image forming process and each structure of the embodiment for an image forming apparatus of the invention will be explained with reference to FIGS. 1–3. FIG. 1 is a sectional structural diagram of a color image forming apparatus showing an embodiment of the invention, FIG. 2 is a side section of the image forming body in FIG. 1, and FIG. 3 is a diagram showing how toner images are formed on both sides in the embodiment.

Photoreceptor drum 10 representing an image forming body is one wherein a cylindrical base body formed by a transparent member such as optical glass or transparent acrylic resin, for example, is provided inside, and a photoconductive layer such as a transparent conductive layer, an a - Si layer or an organic photoconductive layer (OPC) is formed on the outer circumferential surface of the base body, and it is rotated clockwise in the direction shown with an arrow in FIG. 1.

Figure 2:
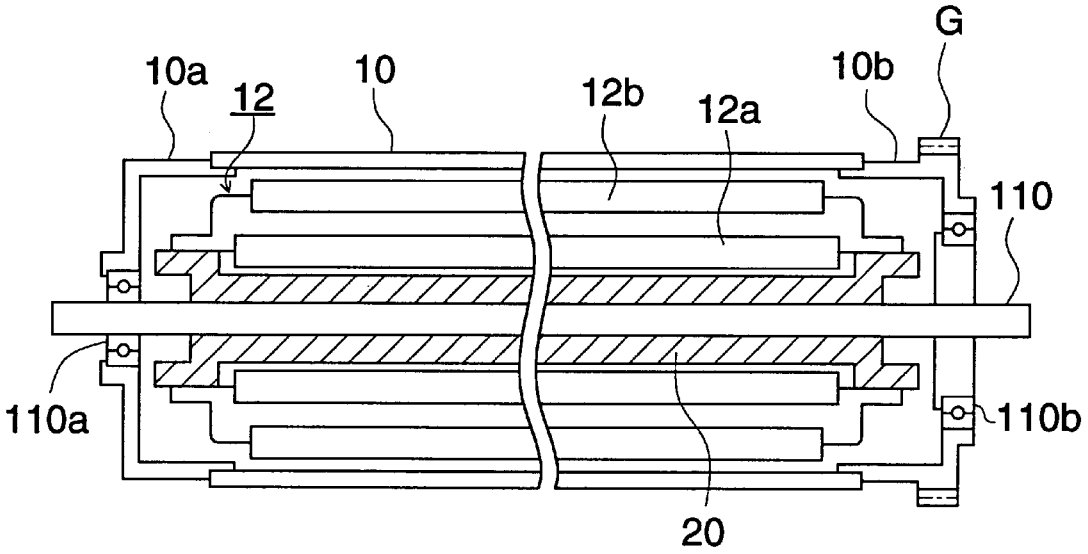
FIG. 2 is a side section of an image forming body in FIG. 1.
Figure 3:
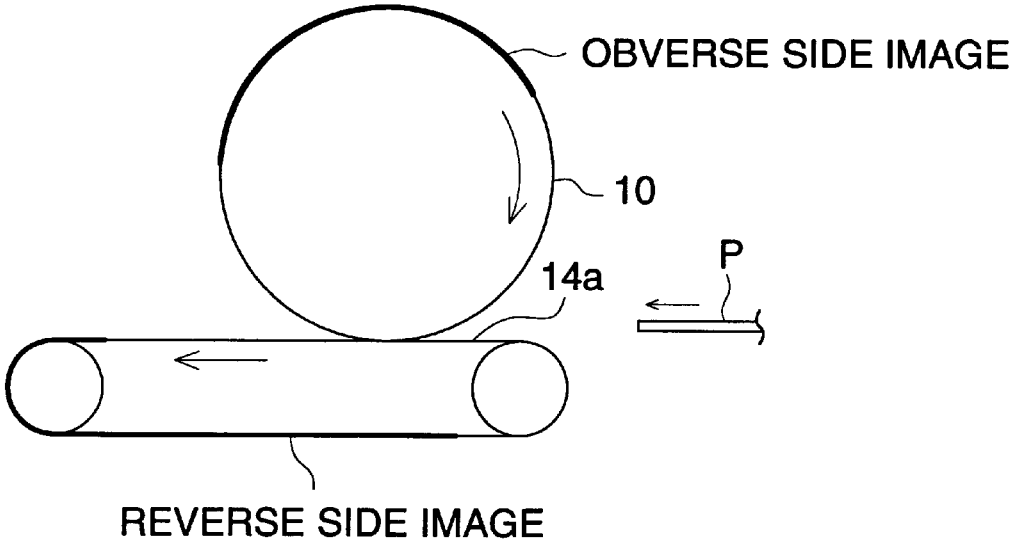
FIG. 3 is an illustration showing how toner images are formed on both sides.

With regard to photoreceptor drum 10, flange members 10*a* and 10*b* located at both ends to engage with the photoreceptor drum to fix it are supported rotatably by bearings 110*a* and 110*b* which are inserted respectively in the flange members 10*a* and 10*b* at both ends for drum shaft 110 fixed on the main body of an apparatus, as shown in FIG. 2, and when gear G uniting with the flange member 10*b* is engaged with a driving gear on the part of the main body of the apparatus to be driven, the photoreceptor drum 10 is rotated at constant speed in the prescribed direction.

Scorotron charger 11 representing a charging means is used in image forming process for each color of yellow (Y), magenta (M), cyan (C) and black (K), and it is mounted to face photoreceptor drum 10 representing an image forming body in the direction perpendicular to the moving direction of the photoreceptor drum 10. The scorotron charger 11 has therein a control grid maintained at a prescribed voltage for the above-mentioned photoconductive layer of the photoreceptor drum 10 and discharge electrode 11*a* composed, for example, of a sawtooth electrode, and conducts charging operations (negative charging in the present embodiment) through corona discharge having the same polarity as that of toner, to give uniform voltage to the photoreceptor drum 10. As the discharge electrode 11*a*, other wire electrodes can also be used.

Exposure unit 12 representing an imagewise exposure means for each color is arranged under the condition that an exposure position on the photoreceptor drum 10 is provided at the upstream side of the photoreceptor drum in its rotation direction for developing sleeve 131 in the area between the discharge electrode 11*a* of the scorotron charger 11 and a developing position of developing unit 13.

The exposure unit 12 is composed of linear light-emitting element 12*a* on which a plurality of LEDs (light-emitting diodes) representing light-emitting elements arranged in the primary scanning direction which is in parallel with an axis of the photoreceptor drum 10 and of an unillustrated holder on which SELFOC lens 12*b* representing a life-size image pickup element are mounted. Holding member 20 on which exposure unit 12 for each color, uniform exposure unit 12*c* and simultaneous transfer and exposure unit 12*d* are mounted is housed inside the base body of the photoreceptor drum 10. Image data for each color obtained by a separate image reading device through its reading and stored in a memory are read out of the memory in succession to be inputted in exposure unit 12 for each color as electric signals.

A light-emitting element to be used includes one wherein a plurality of light-emitting elements such as FL (fluorescence luminescence), EL (electroluminescence) and PL (plasma discharge) are arranged in a form of an array. A preferable wavelength for luminance of a light-emitting element used in the present embodiment includes those in the range of 680–900 nm which are high in terms of transmissivity for normal toner for each of Y, M and C, but the wavelength which is shorter than the foregoing and does not have sufficient transparency for color toner can also be used because imagewise exposure is conducted from the inside (back side) of the photoreceptor drum 10.

With regard to developing units 13 provided along the circumferential surface of a photoreceptor drum rotated in accordance with an order of colors for image forming, developing units 13 for Y and M are arranged on the left side of photoreceptor drum 10 in the rotary direction of the photoreceptor drum 10 shown with an arrow in FIG. 1, and developing units 13 for C and K are arranged on the right side of photoreceptor drum 10, while each of scorotron chargers 11 respectively for Y and M is arranged under each developing casing 138 of each of the developing units 13 for Y and M, and each of scorotron chargers 11 respectively for C and K is arranged over each developing casing 138 of each of the developing units 13 for C and K.

Developing unit 13 representing a developing means for each color contains therein one-component or two-component developing agents for yellow (Y), magenta (M), cyan (C) and black (K), and is provided with developing sleeve 131 which rotates in the same direction as that of photoreceptor drum 10 at the developing position while keeping a prescribed distance from the circumferential surface of the photoreceptor drum 10, and is formed by a non-magnetic stainless steel or aluminum cylinder whose wall thickness is 0.5–1.0 mm and diameter is 15–25 mm.

In the course of developing operations which are conducted by developing unit 13 for each color while developing sleeve 131 is kept, by stopper rolls, to be in non-contact through a clearance of a prescribed value, namely, a developing clearance of 100–1000 μm, for example, from photoreceptor drum 10, developing bias voltage of DC voltage or DC voltage plus AC voltage is impressed on the developing sleeve 131, whereby jumping developing is conducted with one-component or two-component developing agents contained in the developing unit, and then DC bias voltage having the same polarity (negative polarity in the present embodiment) as that of toner is impressed on the photoreceptor drum 10 having negative electric charges with a transparent conductive layer grounded so that non-contact reversal developing is conducted to stick toner on the exposed portion. Accuracy required for the clearance for developing in this case is 20 μm or less for preventing image unevenness.

The developing unit 13 for each color stated above conducts reversal development, under the non-contact state, for an electrostatic latent image on the photoreceptor drum 10 formed through charging conducted by the scorotron charger 11 and imagewise exposure carried out by exposure unit 12 through the non-contact developing method wherein the developing bias voltage stated above is impressed, with toner (toner with negative polarity because the photoreceptor drum is negatively charged in the present embodiment) having the same polarity as that of the charging.

In the image reading device that is separate from the apparatus, image data of a document image read by an image pickup element, or image data of an image edited by a computer are temporarily stored in a memory as image signals for each color for Y (yellow), M (magenta), C (cyan) and K (black).

With start of an unillustrated photoreceptor driving motor caused by start of image recording, gear G provided on flange 10*b* on the inner part of photoreceptor drum 10 is rotated through an unillustrated driving gear, then the photoreceptor drum 10 is rotated clockwise in the direction shown with an arrow in FIG. 1, and donating of voltage to the photoreceptor drum 10 is simultaneously started by charging operations of scorotron charger 11 for Y arranged under developing casing 138 for yellow (Y), at the left side of the photoreceptor drum 10.

After being given voltage, the photoreceptor drum 10 starts to be subjected to exposure by electric signals corresponding to the signals for the first color, namely to image data for Y, in exposure unit 12 for Y, and an electrostatic latent image corresponding to images for Y on a document image is formed on its surface by rotary scanning of the photoreceptor drum 10.

The latent image stated above is subjected to reversal development conducted by developing unit 13 for Y under the non-contact condition, and a toner image for yellow (Y) is formed as the photoreceptor drum 10 rotates.

Then, scorotron charger 11 for magenta (M) arranged over yellow (Y) and under developing casing 138 of developing unit 13 for magenta (M) on the left side of the photoreceptor drum 10 gives voltage, through its charging operation, on the above-mentioned toner image for yellow (Y) on the photoreceptor drum 10, then exposure is conducted by electric signals corresponding to the second color signals of exposure unit for M, namely to image data for M, thus, a toner image for magenta (M) is formed to be superposed on the toner image for yellow (Y) through non-contact reversal development conducted by developing unit 13 for M.

In the same process as in the foregoing, a toner image for cyan (C) corresponding to the third color signals is formed to be superposed by scorotron charger 11 for cyan (C) arranged over developing casing 138 of developing unit 13 for cyan (C) on the right side of the photoreceptor drum 10, exposure unit 12 for C and developing unit 13 for C, and a toner image for black (K) corresponding to the fourth color signals is formed to be superposed in succession by scorotron charger 11 for black (K) arranged over developing casing 138 of developing unit 13 for black (K) under C on the right side of the photoreceptor drum 10, exposure unit 12 and developing unit 13, thus a color toner image is formed on the circumferential surface of the photoreceptor drum 10, while it makes one turn.

Exposure for an organic photoconductor layer of the photoreceptor drum 10 conducted by exposure unit 12 for each of Y, M, C and K is carried out from the inside of the drum through the transparent base body. Therefore, exposure of an image corresponding to each of the second, third and fourth color signals can be conducted without being affected by the toner image formed previously, whereby it is possible to form electrostatic latent images which are the same as the image corresponding to the first color signals.

Due to the image forming process stated above, superposed color toner images which are to be a reverse side image are formed on photoreceptor drum 10 representing an image forming body, and these color toner images representing a reverse side image on the photoreceptor drum 10 are spread between driving roller 14*d* and driven roller 14*e* by the first transfer unit 14*c* on which DC voltage having polarity (positive polarity in the present embodiment) opposite to that of toner is impressed, and are collectively transferred, at transfer area 14, onto toner image receiving body 14*a* representing an intermediate transfer body provided to be close to or to be in contact with the photoreceptor drum 10. In this case, uniform exposure by means of simultaneous transfer and exposure unit 12*d* employing light-emitting diodes is conducted so that excellent transfer may be carried out.

Residual toner remaining on the circumferential surface of the photoreceptor drum 10 after the transfer is subjected to neutralizing conducted by image forming body AC neutralizing unit 16, and then goes to cleaning device 19 where the residual toner is removed by cleaning blade 19*a* composed of rubber material which is in contact with the photoreceptor drum 10. Further, for eliminating hysteresis on the photoreceptor caused by the previous prints, the circumferential surface of the photoreceptor is neutralized by the exposure conducted by pre-charging uniform exposure unit 12*c* employing, for example, a light-emitting diode, then charging for the previous print is removed to be ready for the following color image forming.

Being synchronized with a reverse side image formed on the toner image receiving body 14*a* in the transfer area 14*b*, an obverse side image resulting from the superposed color toner images is formed on the photoreceptor drum 10 in the same manner as in the color image forming process stated above. The obverse side image which has been formed on the toner image receiving body 14*a* and the state of formation of toner images for an obverse side image to be formed on the photoreceptor drum 10 at this time are shown in FIG. 3. Incidentally, it is necessary to change image data so that an obverse side image formed in this case may be a mirror image with a reverse side image formed on the photoreceptor drum 10.

Recording sheet P representing a transfer material is fed out of sheet-feeding cassette 15 representing a transfer material housing means by feed-out roller 15*a*, and then is fed by feeding roller 15*b* to be conveyed to timing roller 15*c*.

Recording sheet P is conveyed to transfer area 14*b* when a color toner image representing an obverse side image carried on photoreceptor drum 10 is synchronized with a color toner image representing a reverse side image carried on toner image receiving body 14*a* by the drive of timing roller 15*c*. In this case, the recording sheet P is sheet-charged to have the same polarity as that of toner by sheet-charger 14*f* serving as a transfer material charging means, and is adsorbed to the toner image receiving body 14*a* to be conveyed to transfer area 14*b*. By sheet-charging the recording sheet to have the same polarity as that of toner, the recording sheet is prevented from attracting a toner image on the toner image receiving body 14*a* and a toner image on the photoreceptor drum 10, thus, disturbance of a toner image can be prevented. As a transfer material charging means, it is also possible to use ordinary roller and brush chargers which can be brought into or released from toner image receiving body 14*a*.

Obverse side images on the circumferential surface of photoreceptor drum 10 are collectively transferred onto the surface side (obverse side) of recording sheet P by the first transfer unit 14*c* representing the first transfer means on which a voltage with polarity (positive polarity in the present embodiment) opposite to that of toner is impressed. In this case, reverse side images on the circumferential surface of toner image receiving body 14*a* are not transferred onto the recording sheet P and stay on the toner image receiving body 14*a*. Then, reverse side images on the circumferential surface of toner image receiving body 14*a* are collectively transferred onto the back side (reverse side) of recording sheet P by reverse side transfer unit 14*g* representing the second transfer means on which a voltage with polarity (positive polarity in the present embodiment) opposite to that of toner is impressed.

Since toner images each being for each color are superposed each other, it is preferable that toner in an upper portion of a layer and toner in a lower portion of a layer have the same amount of charges and both of them are charged to have the same polarity. From the aforesaid viewpoint, in the double-sided image forming wherein polarity of a color toner image formed on toner image receiving body 14*a* is reversed by corona charging, and polarity of a color toner image formed on photoreceptor drum 10 is reversed by corona charging, toner in the lower portion of the layer is not charged sufficiently to have the same polarity, and transfer failure is caused accordingly, which is not preferable from the viewpoint mentioned above.

It is preferable that reversal development is repeated on photoreceptor drum 10, then, color toner images having the same polarity formed to be superposed are collectively transferred onto toner image receiving body 14*a* without being changed in terms of polarity, and then are transferred collectively onto recording sheet P without being changed in terms of polarity, because it contributes to improvement of transferability for reverse side image forming. Even for obverse side image forming, it is preferable that reversal development is repeated on photoreceptor drum 10, and color toner images having the same polarity formed to be superposed are collectively transferred onto recording sheet P without being changed in terms of polarity, because it contributes to improvement of transferability for obverse side image forming.

In color image forming, therefore, a double-sided image forming method wherein the first transfer means and the second transfer means are provided separately, and the first transfer means is operated so that a color toner image is formed on the obverse side of a transfer material and the second transfer means is operated so that a color toner image is formed on the reverse side of a transfer material, is preferably used.

Toner image receiving body 14*a* is an endless rubber belt having a thickness of 0.5–2.0 mm, and it is of a two-layer structure having therein a semiconductive base body with resistance value of $10^8$–$10^{12}$ ω·cm such as silicone rubber or urethane rubber, and a rubber base body whose outer surface is provided with a fluorine coating having a thickness of 5–50 μm which serves as a toner filming preventing layer. It is preferable that this rubber base body layer is also semiconductive. In place of the rubber belt base body, semiconductive polyester, polystyrene, polyethylene and polyethylene terephthalate each having a thickness of 0.1–0.5 mm can also be used.

Recording sheet P representing a transfer material having color toner images formed on its both sides is neutralized by sheet separation AC neutralizing unit 14*h* for transfer material separation use, then separated from toner image receiving body 14*a*, and is conveyed to fixing device 30 representing a fixing means that is composed of two upper and lower fixing rollers each having therein a heating means (heater). When the recording sheet P is positioned between the first fixing roller 310 on the upper side and the second fixing roller 320 on the lower side, heat and pressure are given to the recording sheet P, whereby toner sticking to the obverse side of the recording sheet P and toner sticking to the reverse side of the recording sheet P are fixed, and the recording sheet P which has been subjected to double-sided image recording is conveyed by sheet-feeding roller 18 to be ejected to a tray which is located outside an apparatus.

Residual toner staying on the circumferential surface of the toner image receiving body 14*a* after the transfer is removed by a blade which is provided on toner image receiving body cleaning device 14*i* representing a cleaning means for the toner image receiving body and is capable of coming in contact with and of leaving from the toner image receiving body 14*a*. Residual toner staying on the circumferential surface of photoreceptor drum 10 after the transfer is neutralized by image forming body AC neutralizing unit 16, then arrives at cleaning device 19 where the residual toner is scraped off into the cleaning device 19 by cleaning blade 19*a* which is made of rubber material and is in contact with photoreceptor drum 10, and is collected into an unillustrated waste toner container by screw 19*b*. The photoreceptor drum 10 from which the residual toner has been removed by the cleaning device 19 is subjected to neutralizing of the circumferential surface of the photoreceptor by the exposure conducted by uniform exposure unit 12*c*, and then is charged uniformly by scorotron charger 11 for Y to be ready for the succeeding image forming cycle.

Figure 4:
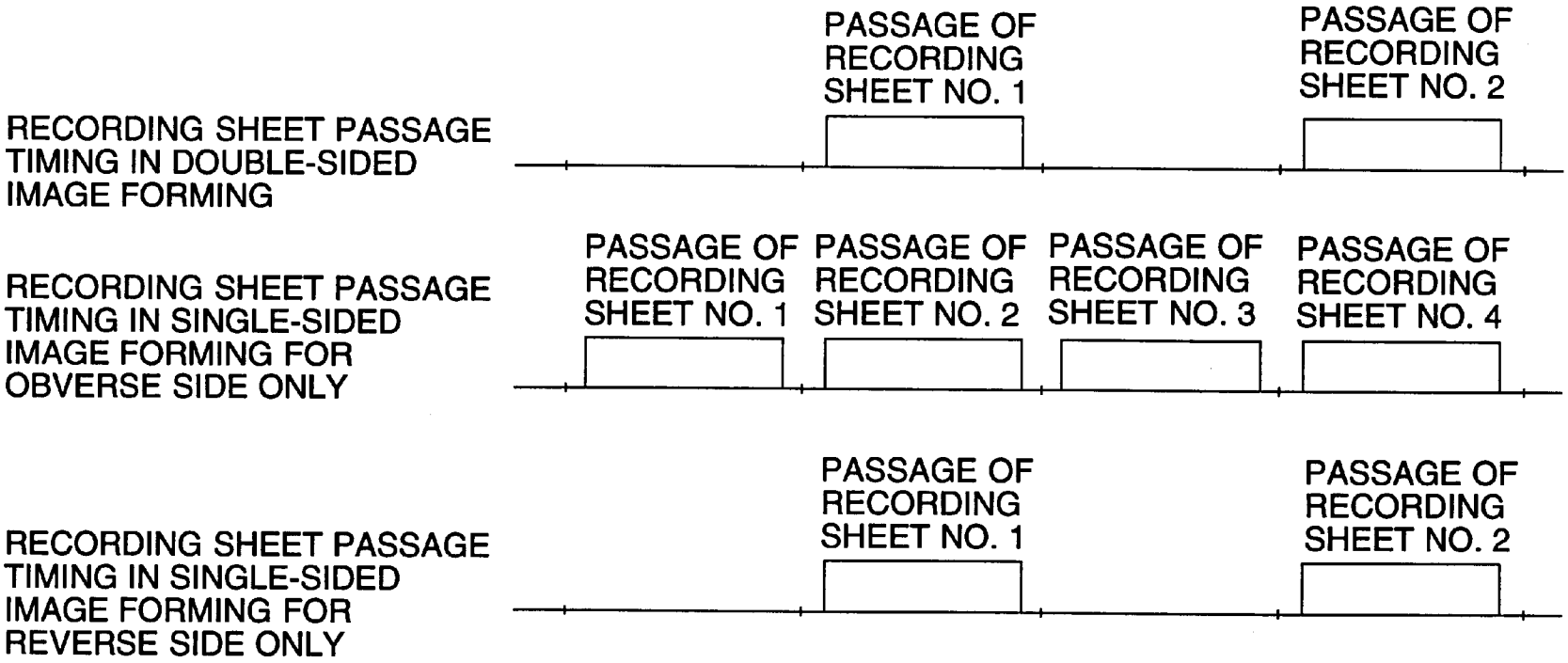
FIG. 4 is an illustration showing the relation between a copy mode and an image interval.

In the image forming apparatus stated above, single-sided copying conducted by the first image carrying means or by the second image carrying means is naturally possible, and as single-sided copying, single-sided copying (single-sided image forming) on the obverse side only conducted by photoreceptor drum 10 is commonly used. As shown in FIG. 4, though the recording sheet P passing through fixing device 30 in the case of single-sided image forming on the obverse side only conducted by photoreceptor drum 10 is conducted continuously, the recording sheet P passing through the fixing device 30 in the case of double-sided image forming is conducted intermittently, because the step to form the obverse side image on photoreceptor drum 10 is repeated after forming the reverse side image on toner image receiving body 14*a* once. Therefore, the printing speed in double-sided image forming is half that in single-sided image forming.

In the fixing device 30 used in an image forming apparatus of the invention, it is necessary that both of the first fixing roller 310 facing the obverse side toner image and the second fixing roller 320 facing the reverse side toner image have a heating means, and the recording sheet P is heated and fixed from its both sides, and a portion where the first fixing roller 310 and the second fixing roller 320 are in contact with each other needs to have a nip portion which measures several millimeters in the direction for conveying the recording sheet for conducting the fixing, and it is necessary, for forming a nip portion, to provide an elastic body layer composed of an elastic body such as silicone rubber or the like on either roller. Since thermal conductivity of the elastic body layer is lower than that of metallic material, a fixing roller on which an elastic body layer is provided loses heat when the recording sheet passes through the fixing roller and its lowered surface temperature requires a long time to be restored. Therefore, the first fixing roller 310 which takes charge of single-sided image forming on the obverse side only having the high speed of printing is made to be a hard roller, while a soft roller is the second fixing roller 320 on which an elastic body layer is provided.

Figure 5:
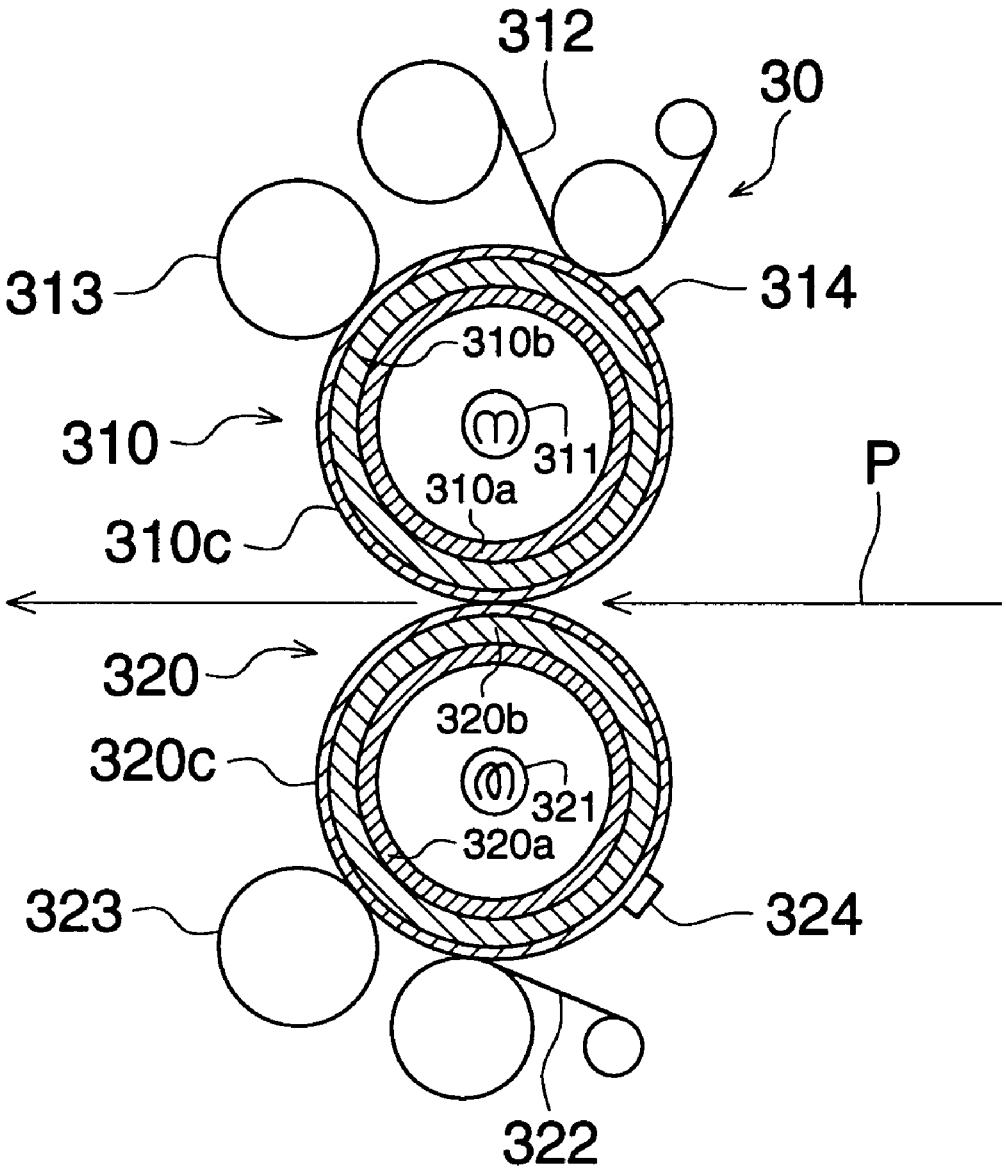
FIG. 5 is a sectional structural diagram of a fixing device which is used in the invention.

FIG. 5 is a structural diagram showing an embodiment of a fixing device used in the present image forming apparatus.

The first fixing roller 310 and the second fixing roller 320 are respectively provided with the first heater 311 representing the first heating means and the second heater 321 representing the second heating means, each of them being composed of a halogen lamp positioned at an inner core section, and both of them represent a rotary body for fixing use having the same structure. With regard to roller portions of the first and second fixing rollers, there are provided elastic body layers 310*b* and 320*b* each being composed of an elastic body such as silicone rubber having a thickness ranging from 0.8 mm to 2.2 mm that is different between the first fixing roller 310 and the second fixing roller 320, respectively on core metals 310*a* and 320*a* each being composed of a metal pipe, and there are provided PFA layers (perfluoroalkyl vinyl ether) layers having a thickness of 0.05–0.25 mm as outermost layers 310*c* and 320*c*. Incidentally, as outermost layers 310*c* and 320*c*, heat-resisting and highly releasing layers such as layers of fluorocarbon resin or silicone resin represented by PTFE (polytetrafluoro ethylene) are used in addition to PFA.

With regard to a layer thickness of elastic body layer 310*b* of the first fixing roller 310 stated above, it is made smaller than the thickness of elastic body layer 320*b* of the second fixing roller 320, or it is made to be zero to make the so-called hard roller, and the second fixing roller 320 is made to be a soft roller. Further, a wall thickness of core metal 310*a* of the first fixing roller is made to be thicker so that thermal capacity of the first fixing roller 310 may be greater than that of the second fixing roller 320.

In the structure, web cleaning units 312 and 322 each being made of nonwoven fabric, for example, are in light contact with the surfaces of the first and second fixing rollers 310 and 320 respectively for removing toner and paper dust sticking to the surfaces.

Further, for enhancing releasing properties of the first and second fixing rollers 310 and 320, there are provided oil-coating rollers 313 and 323 each of which is sponge-like and contains oil and coats releasing agents such as dimethylsilicone oil or denatured silicon oil on the roller surface.

Further, the first and second temperature sensors 314 and 324 representing respectively the first and second temperature detecting means each being composed of a thermistor are provided to be in contact respectively with or to be extremely close respectively to the first fixing roller 310 and the second fixing roller 320, whereby a temperature on the surface of the roller is detected, and based on signals of this detection, energizing of the first heater 311 and that of second heater 321 are controlled so that the temperature is kept within a prescribed temperature range.

The first fixing roller 310 and the second fixing roller 320 are made to be in pressure contact each other with a linear load of 0.8–1.8 kg/cm by an unillustrated urging member such as a spring, and a length of the nip portion in this case is made to be about 2–7 mm by making the second fixing roller 320 to be a soft roller, though the length of the nip portion varies depending on the linear load and hardness of the roller. The first fixing roller 310 and the second fixing roller 320 are driven by the same driving source to be rotated at the same linear speed (160 mm/sec in the present example) so that they do not slip on the nip portion, whereby double-sided fixing is conducted in the nip portion.

Figure 13:
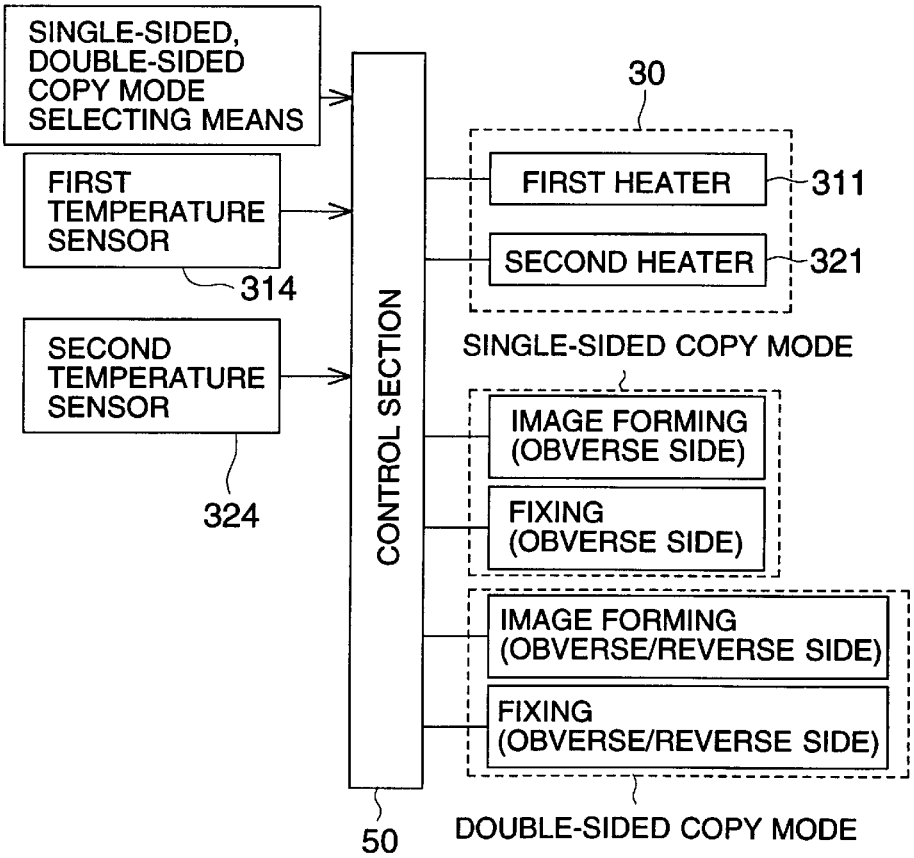
FIG. 13 is a block diagram of a control system which is common in Embodiment 1–Embodiment 3.

In the case of an image forming apparatus equipped with the fixing device 30 stated above, a copy mode selecting button representing a means to select between a single-sided copy mode and a double-sided copy mode is provided on a main body operation panel in the block diagram shown in FIG. 13, and the single-sided copy mode, or the double-sided copy mode is selected by a user. In addition to this, an automatic copy mode which conducts automatic selection is provided to conduct image forming and fixing, in which a single-sided copy mode is selected automatically when a reverse side image is not detected and a double-sided copy mode is selected automatically when a reverse side image is detected, when reading images of a document with an unillustrated image reading device and detecting existence of an image on the reverse side of the document.

When the single-sided copy mode is selected, control section 50 calls information of images on the obverse side from a memory or from a document reading device, and forms toner images of the obverse side images on photoreceptor drum 10 to transfer the toner images of the obverse side images on the photoreceptor drum 10 onto recording sheet P which is fed by the first transfer unit 14*c* in synchronization (first image forming step). For the recording sheet P conveyed to fixing device 30 while holding toner images on its obverse side, obverse side images are fixed in the fixing device 30, and then the recording sheet P which has been subjected to fixing is conveyed by sheet-ejecting roller 18 to be ejected onto a tray located outside an apparatus.

When the double-sided copy mode is selected, the control section 50 calls information of images on the reverse side from a memory or from a document reading device, and forms toner images of the reverse side images on photoreceptor drum 10 to transfer the toner images of the obverse side images onto toner image receiving body 14*a* representing an intermediate transfer body with the first transfer unit 14*c*. Then, toner images for the obverse side images are formed on photoreceptor drum 10 which has been finished in terms of transfer and cleaning. Then, toner images of the obverse side images are transferred onto the upper side (surface) of recording sheet P which is conveyed in synchronization by the first transfer unit 14*c* (first image forming step), while toner images of the reverse side images on the toner image receiving body 14*a* are transferred onto the lower side of recording sheet P by reverse side transfer unit 14*g* (second image forming step). For the recording sheet P conveyed to fixing device 30 while holding toner images on its both sides, images on both sides are fixed in the fixing device 30, and then the recording sheet P which has been subjected to fixing is conveyed by sheet-ejecting roller 18 to be ejected onto a tray located outside an apparatus.

In the image forming apparatus of the present embodiment, the first fixing roller 310 is made to be a hard roller and the second fixing roller is made to be a soft roller equipped with an elastic body layer so that the apparatus may comply not only with double-sided copy mode but also with single-sided copy mode which makes high speed printing possible. Therefore, heat response for the second fixing roller 320 is poor while that for the first fixing roller 310 is excellent. Due to this, in the case of the double-sided copy mode or the reverse side copy mode, the temperature on the roller surface of the second fixing roller 320 is lowered when continuous printing is conducted, which is a problem.

Figure 6:
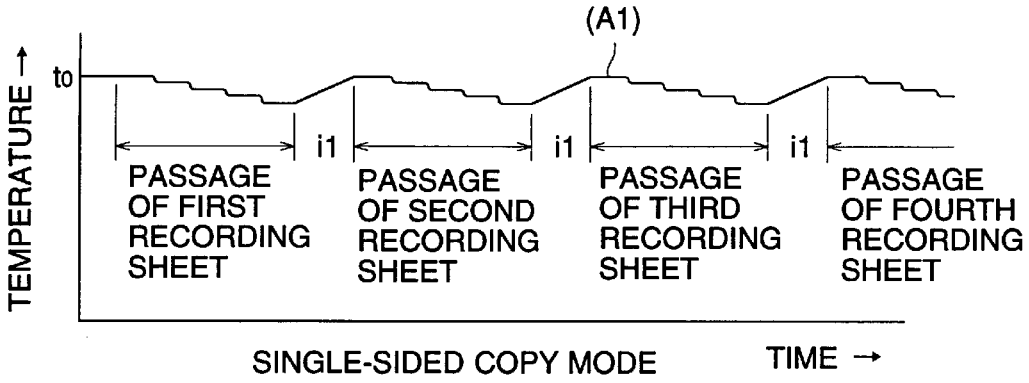
FIGS. 6(*a*) and 6(*b*) represent an illustration showing the state of surface temperature of the first fixing roller under the single-sided copy mode and that under the double-sided copy mode.
Figure 6:
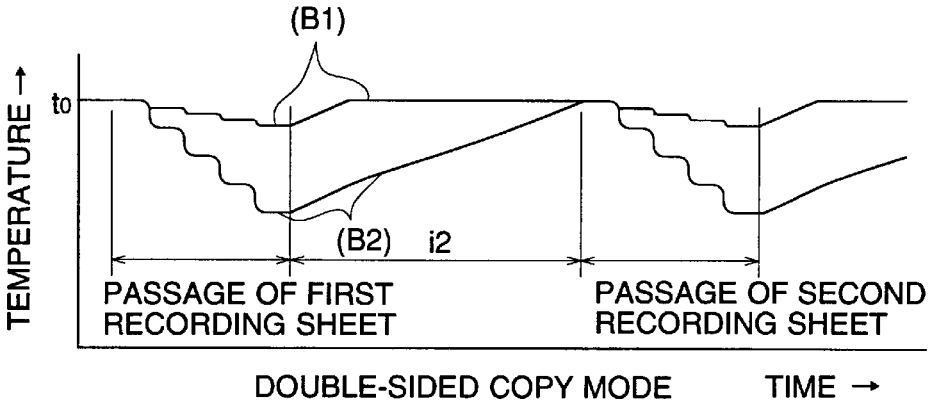

FIG. 6 represents illustrations showing the aforesaid relation illustratively, wherein (*a*) shows the state of surface temperature (A1) of the first fixing roller 310 in single-sided print mode for the obverse side. Since the first fixing roller 310 is a hard roller, the amount of heat generated from the first heater 311 is conducted to the roller surface in a short period of time through heat conduction, and heat capacity is great. Therefore, a temperature decline caused by passage of the first recording sheet is slight, and initial temperature $t_0$ can be restored sufficiently in short time interval i1 during which the second recording sheet arrives, thus, excellent fixing can be conducted intermittently for continuous copying for a large amount of sheets.

FIG. 6(*b*) shows the state of surface temperature (B1) of the first fixing roller 310 under the double-sided copy mode (B1) and the state of surface temperature of the second fixing roller 320 (B2). Since the second fixing roller 320 is a soft roller, replenishment through heat conduction for the amount of heat taken by the passage of the first recording sheet is not sufficient, and thereby the surface temperature of the second fixing roller 320 after the passage of the first recording sheet is lowered. The lowered surface temperature of the second fixing roller 320 is raised within relatively long period of time interval i2 during which the second recording sheet arrives, so that its initial temperature $t_0$ is restored. Though this temperature rise on the surface of the second fixing roller 320 made during the time interval i2 is caused by heat conduction of the amount of heat generated from the inside of the second heater 321, heat conduction from the first fixing roller 310 which is in contact with the second fixing roller and rotates mainly contributes to that temperature rise.

Figure 7:
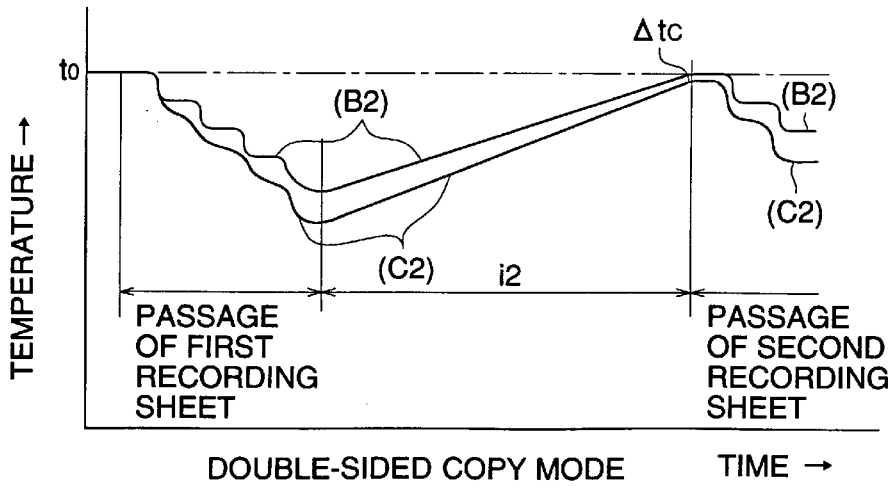
FIG. 7 is an illustration showing the state of surface temperatures of the second fixing roller, wherein the transfer materials are different in terms of quality of materials.

The state of temperature on the surface of the second fixing roller 320 under the double-sided copy mode is taken out and is shown in FIG. 7, and what is shown in (B2) represents the state of the surface temperature wherein an ordinary sheet is used as a recording sheet to be fixed. What is shown in (C2) is the state of surface temperature in the case where the material having great heat capacity is used as a recording sheet. When a material having great heat capacity such as thick sheet, for example, is fixed as a recording sheet, that recording sheet absorbs more heat in the course of fixing compared with an ordinary sheet, thereby the surface temperature of the second fixing roller 320 is lowered. Therefore, when images are formed on a recording sheet having great heat capacity in an image forming apparatus structured for an ordinary sheet, the surface temperature of the second fixing roller 320 is not restored to the initial temperature $t_0$ and is on the state of $t_0-\Delta t_C$ when the leading edge of the second recording sheet arrives at fixing device 30. When printing is continued for the second recording sheet and the third recording sheet under this condition, fixing temperature of the second fixing roller 320 is lowered gradually by $\Delta t_C$. In the beginning, fixing is hardly affected by lowered temperature, but when fixing is continued for a large number of sheets, fixing failure is caused on the reverse side toner images.

Figure 8:
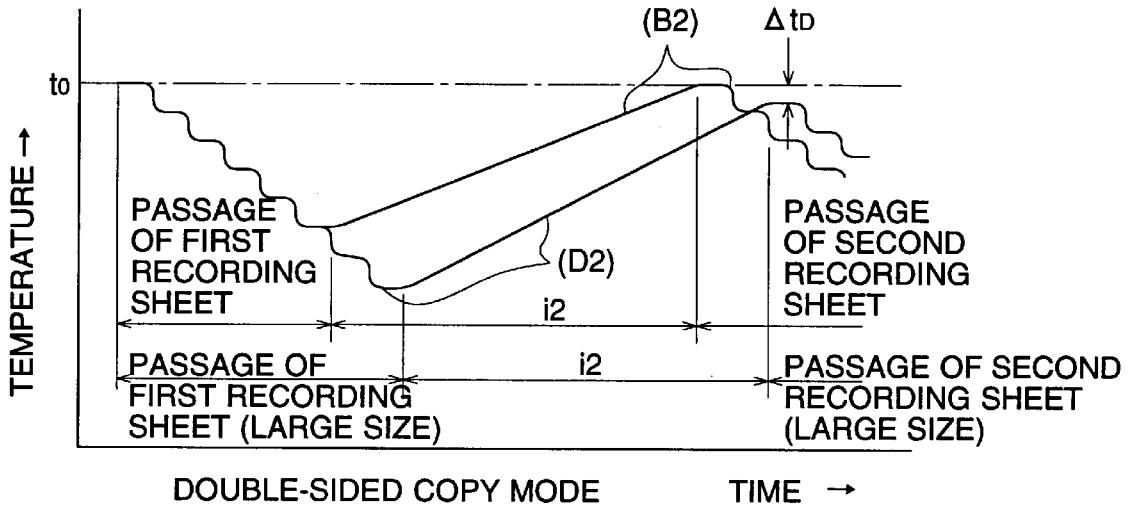
FIG. 8 is an illustration showing the state of surface temperatures of the second fixing roller, wherein the sheets are different in terms of size.

The state of temperature on the surface of the second fixing roller 320 under the double-sided copy mode is taken out and is shown in FIG. 8 as in FIG. 7, and what is shown in (B2) represents the state of the surface temperature wherein an ordinary sheet in an ordinary size is used as a recording sheet to be fixed. What is shown in (D2) is the state of the surface temperature in the case when a recording sheet of an ordinary sheet in a large size passes. In the case of a large-sized recording sheet, heat absorption from the roller into the recording sheet is conducted for a longer time, compared with a normal size, and when the fixing of the first recording sheet is completed, the surface temperature of the second fixing roller 320 is low. Therefore, when images are formed on a large-sized recording sheet in an image forming apparatus structured for a recording sheet in an ordinary size, the surface temperature of the second fixing roller 320 is not restored to the initial temperature $t_0$ and is on the state of $t_0-\Delta t_D$ when the leading edge of the second recording sheet in a large size arrives at fixing device 30. When printing on a large-sized recording sheet is continued for the second recording sheet and the third recording sheet under this condition, fixing temperature of the second fixing roller 320 is lowered gradually by $\Delta t_D$. In the beginning, fixing is hardly affected by lowered temperature, but when fixing is continued for many sheets such as several to several tens of sheets, fixing failure is caused on the reverse side toner images.

In the image forming apparatus of the invention, the control to broaden the image interval that is for forming images is made without changing the process speed so that fixing failure may not be caused for the reverse side image even when printing continuously by using recording sheets having greater heat capacity than ordinary sheets, or when printing continuously using recording sheets which are larger than an ordinary size, under the double-sided copy mode or the reverse side copy mode. This control is not conducted for each sheet, but it is conducted for continuous prints in a large number such as from several sheets to several tens of sheets.

Next, an embodiment which attains the first object will be explained as follows.

(Embodiment 1)

Figure 9:
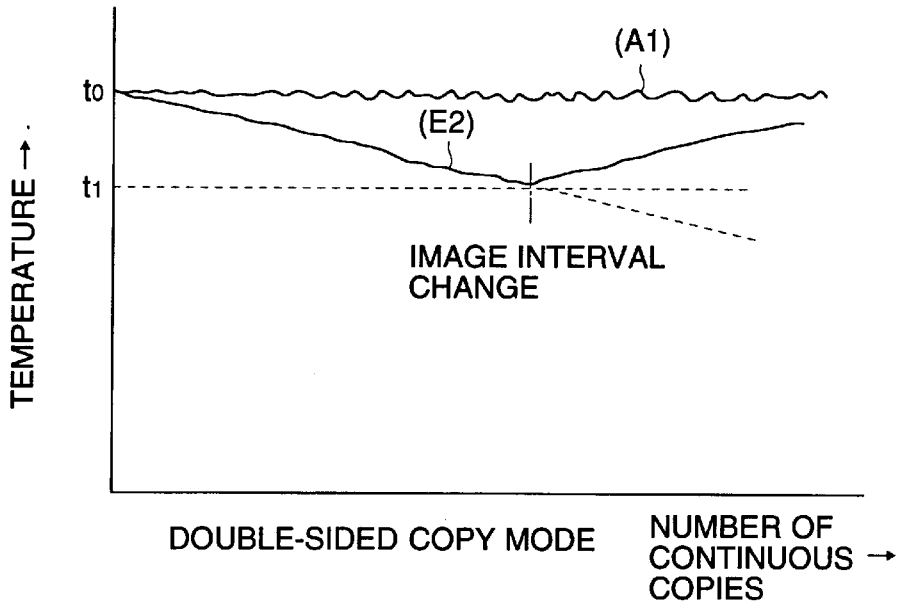
FIG. 9 is an illustration explaining operations in Embodiment 1.
Figure 10:
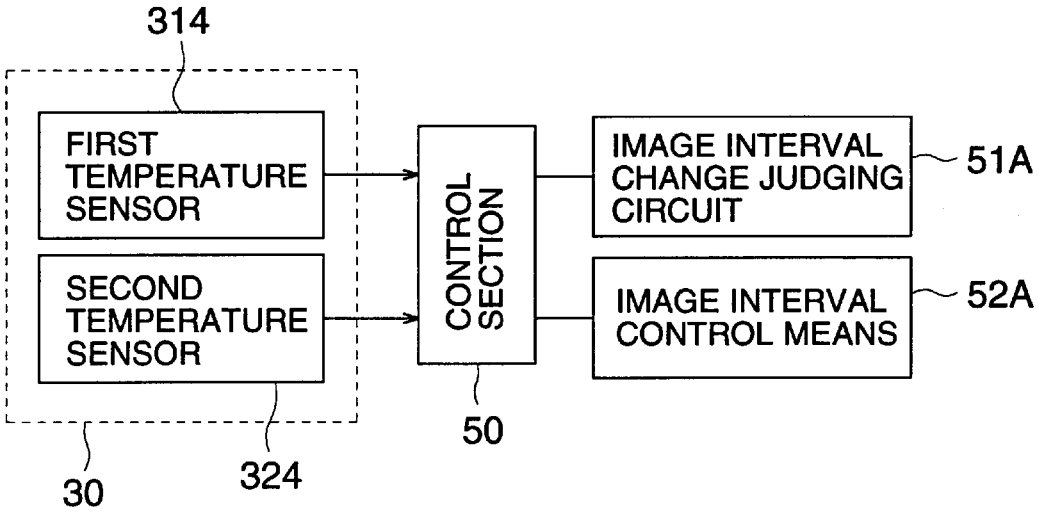
FIG. 10 is a block diagram of a control system in Embodiment 1.

An image forming apparatus of the present embodiment is equipped with a control means which changes an image interval, and when the temperature deviation from the prescribed temperature of the second fixing roller 320 is greater than the allowable range, the control means changes the image interval to be larger. FIG. 9 is an illustration of the present embodiment, and FIG. 10 is a block diagram which takes out the control system of the present embodiment and shows it.

FIG. 9 shows how the surface temperatures of the first fixing roller 310 and the second fixing roller 320 fluctuate when continuous copying is conducted under the double-sided copy mode. The first fixing roller 310 representing a hard roller is kept at $t_0$ which is a prescribed temperature in almost initial stage, in the course of fixing, as shown in (A1), and the obverse side images are fixed. On the other hand, when the recording sheet is one having great heat capacity or one that is larger than a standard, the surface temperature in the course of fixing is lowered gradually as shown in the second fixing roller 320 representing a soft roller (E2). The temperature of the first fixing roller 310 in this case tends to be pulled down by the temperature of the second fixing roller 320 to be lowered slightly. In the present embodiment, when the temperature is lowered to be not more than established temperature $t_1$ which makes fixing possible and is lower than prescribed temperature $t_0$, the control section 50 judges to change image intervals with image interval change judging circuit 51A, and changes image intervals with image interval control means 52A. Incidentally, as an amount of change of image intervals, it is preferable to change to 1.5 times to 4 times the image interval in the case of the above-mentioned judgment (existing). Due to this change of image intervals, the surface temperature of the second fixing roller 320 in the course of fixing approaches fixing temperature $t_0$ gradually while the fixing operations are continued as shown in FIG. 9.

Incidentally, when the temperature detected by second temperature sensor 324 is lower than established temperature $t_1$ for plural sheets, namely, for 5 sheets or more, for example, even when the image interval is changed to be broadened by the image interval control means 52A, it is also possible to make secondary control to further broaden the image interval.

Further, a counter is provided on the control section 50, then the number of copies corresponding to the period from the start of continuous copying to the moment when the temperature of the second fixing roller 320 is lowered to the established temperature $t_1$ or below is measured, and when the temperature is lowered to the established temperature $t_1$ or lower within 20 copies, for example, the control is made so that the image interval is broadened to 4 times the existing image interval and when the temperature is lowered to the established temperature $t_1$ or lower after the number of copies exceeds 20 copies, the control is made so that the image interval is broadened to 2 times the existing image interval. Thus, the decline of the processing speed for image processing is controlled to the utmost for image forming by conducting plural steps of image interval control.

(Embodiment 2)

Figure 11:
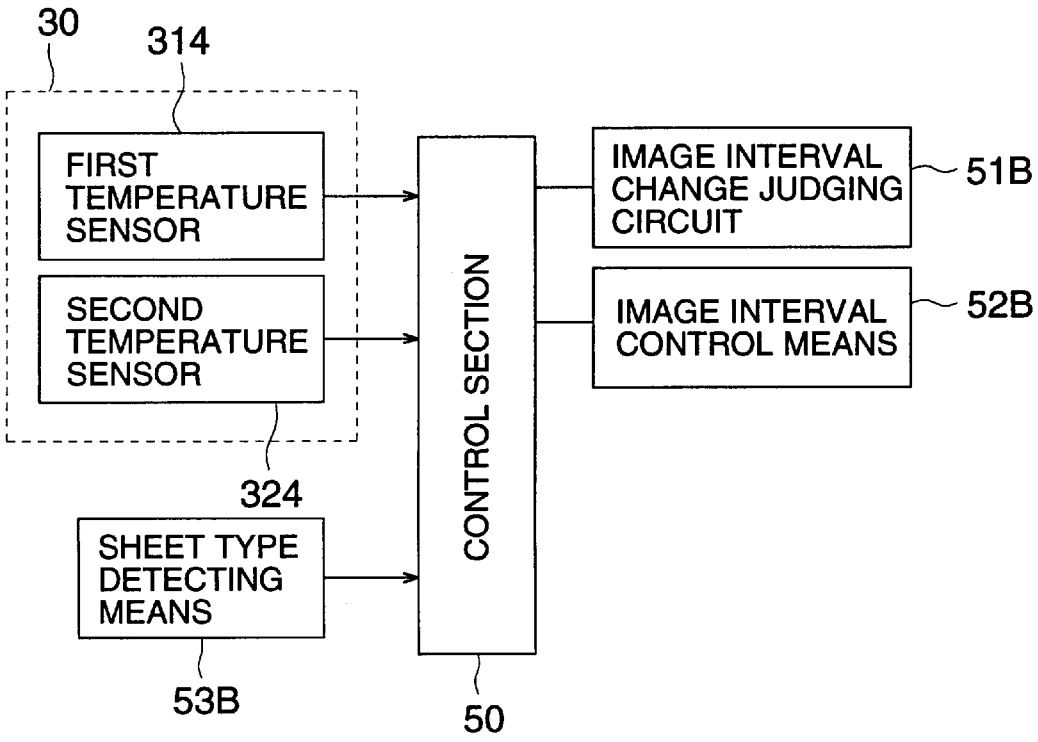
FIG. 11 is a block diagram of a control system in Embodiment 2.

An image forming apparatus of the present embodiment is equipped with a control means which changes an image interval, and when the heat capacity of a transfer material is greater compared with heat capacity of an ordinary sheet, depending on the material of the transfer material for continuous copying, the image interval is changed to be greater. FIG. 11 is a block diagram which takes out the control system of the present embodiment and shows it.

For the detection of material of a transfer material, it is possible to provide sheet quality detecting means 53B along the conveyance path for the transfer material, but it is also possible to detect sheet quality by the use of sheet charging unit 14*f*. Namely, under the state where a transfer material is interposed between sheet charging unit 14*f* serving as a brush charging unit and toner image receiving body 14*a*, voltage containing AC component is impressed temporarily on the sheet charging unit 14*f* to detect a sheet thickness (heat capacity) from impedance, and this impedance is compared with impedance of an ordinary sheet stored in a memory in advance by image interval change judging circuit 51B to judge whether the image interval needs to be broadened or not. When the recording sheet to be fixed is judged to be a thick sheet having greater heat capacity than an ordinary sheet, the image interval is changed to 1.5 times–4 times the existing image interval by image interval control means 52B. Incidentally, a change of this image interval does not need to be made from the beginning of continuous copying, and it is possible to control so that the existing image interval is kept until 10 copies are made, and then is broadened on and after the 11th copy.

When a recording sheet is a thick sheet, the recording sheet is fed manually in many cases. Therefore, it is possible to judge the recording sheet fed manually to be a thick sheet and to control so that an image interval is broadened.

In an image forming apparatus of the present embodiment, an image interval is controlled to be changed in accordance with the material of a recording sheet, but a combination of this control and the control to broaden an image interval when the temperature of the second fixing roller 320 explained in Embodiment 1 in the course of fixing is lowered to be lower than the prescribed temperature provides excellent effects to offer satisfactory fixing without lowering the processing speed than is needed. For example, in the case of continuous copying under the double-sided copy mode, a sheet is first detected by sheet quality detecting means 53B whether it is a thick sheet or not, and when the sheet is detected to be a thick sheet, an image interval is changed to 1.5 times to 3 times the initial image interval on and after the 11th copy, for example. On and after this change, the roller surface temperature of the second fixing roller 320 is detected by the second temperature sensor 324, and the detected temperature is compared with established temperature $t_1$, and when the roller surface temperature of the second fixing roller 320 is lowered to be under the established temperature $t_1$, the image interval is changed to 1.5 times–3 times the then image interval. Such combination of the controls makes it possible to provide an image forming apparatus wherein the processing speed for image forming is not lowered than is necessary, and excellent double-sided fixing can be conducted.

(Embodiment 3)

Figure 12:
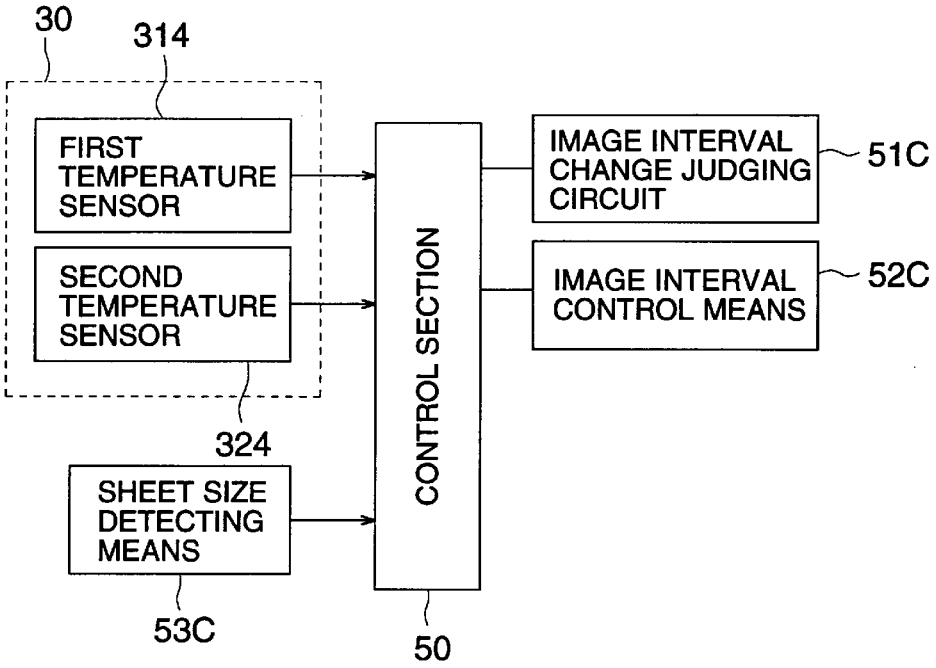
FIG. 12 is a block diagram of a control system in Embodiment 3.

An image forming apparatus of the present embodiment is equipped with a control means which changes an image interval, and it changes the image interval to be greater when a size of a transfer material for continuous copying in its conveyance direction is greater than a reference size (for example, A4 size). FIG. 12 is a block diagram which takes out the control system of the present embodiment and shows it.

A size of a transfer material is detected by sheet size detecting means 53C. The sheet size is detected by this sheet size detecting means 53C when the passage time of the transfer material is detected by photosensors provided along the conveyance path for a transfer material. Further, the recording sheet size is detected from the size of a sheet-feeding cassette housing therein recording sheets which will be ejected later. In the image interval change judging circuit 51C, comparison with the reference size (for example, A4 size) stored in a memory in advance. This comparison may either be one for a length in the feeding direction of a recording sheet to be fed, or be one for the size representing a B4 size or an A3 size. When the recording sheet for continuous copying is judged to be greater than the reference size, the image interval is changed by image interval control means 52C to 1.5 times–4 times the existing image interval. It is also possible to change image intervals by means of a program provided in advance, in a way that an image interval is changed to 2 times the existing image interval when the recording sheet detected for the reference size A4 is B4 size, while an image interval is changed to 4 times when the detected sheet size is A3 size. Incidentally, a change of this image interval does not need to be made from the beginning of continuous copying, and it is possible to control so that the existing image interval is kept until 20 copies are made when the detected recording sheet size is B4 size, for example, and then is broadened to 2 times on and after the 21st copy, while the existing image interval is kept until 10 copies are made when the detected recording sheet size is A3 size, for example, and then is broadened to 4 times on and after the 11th copy.

In an image forming apparatus of the present embodiment, when the detected recording sheet size is greater than the reference size, the image interval is controlled to be changed, but a combination of this control and the control to broaden the image interval when the temperature of the second fixing roller 320 explained in (Embodiment 1) in the course of fixing is lowered to the temperature that is lower than the prescribed temperature, makes it possible to provide an image forming apparatus wherein the processing speed is not lowered than is necessary, and excellent fixing can be conducted.

It is also possible to employ the control wherein several steps for the change of image intervals are conducted by changing in accordance with the fixing temperature and its temperature change, and thereby the change of the printing speed is not recognized by a user.

Due to the embodiment stated above, an image forming apparatus wherein fixing failure is not caused, operations are not suspended, and excellent image forming can be carried out at the same process speed under the conditions of double-sided copy mode and continuous copying has come to be provided.

Next, there will be given an explanation of an embodiment attaining the second object which, however, is preceded by explanation of terminologies. A wording of an image forming interval used here is a length (elapsed time) from the leading edge of an image formed previously to that of an image formed subsequently measured on a sheet-feeding path. A wording of a sheet-feeding interval used here is a length (elapsed time) from the moment when the leading edge of a preceding transfer material passes to the moment when the leading edge of a subsequent transfer material passes, measured on a sheet-feeding path. Further, an interval between images is a length (elapsed time) from the trailing edge of an image formed precedingly to the leading edge of an image formed subsequently, measured on the sheet-feeding path. This interval between images needs to be longer than the shortest period of time (length on photoreceptor drum 10) required for the period from the end of writing of the preceding image to the start of writing of the subsequent image, or longer than the shortest period of time (length on a sheet-feeding path) required for the time period from the passage of the trailing edge of a transfer material to the passage of the leading edge of the subsequent transfer material. In the image forming apparatus, there is a shortest interval between images which makes image forming possible, and a length including this shortest interval between images and a certain amount of room therefor is called a necessary interval between images.

FIGS. 15(*a*)–15(*d*) are an illustration showing the relation between image forming and sheet-feeding timing conducted continuously in the past. The image forming apparatus explained here is one capable of forming double-sided images whose maximum size is A3, and a length (circumferential length) of intermediate transfer body 14*a* in this case is set to the length wherein the necessary interval between images (which is shown with Δ in the drawing) is added to the length of A3.

In FIG. 15(*a*) shows timing in forming of double-sided images in A3 size, and FIG. 15(*b*) shows timing in forming of single-sided image in A3 size. Further, FIG. 15(*c*) shows timing in forming of double-sided images in B4 size, and FIG. 15(*d*) shows timing in forming of single-sided image in B4 size. The image forming interval for the reverse side image and the obverse side image which is formed after the reverse side image in the course of double-sided image forming needs to be the same as a length of one turn of the intermediate transfer body 14*a* independently of the image size. The image forming interval for the obverse side image and the reverse side image representing the following image and the image forming interval for single-sided image forming have been set to be the same as the image forming interval for the preceding reverse side image and the obverse side image, because the constant image forming interval has made timing control to be easy in the past. FIG. 15 shows these conditions, and the image forming interval has been broadened by the difference of length between A3 size and B4 size (>Δ) in FIG. 15(*c*, and FIG. 15(*d*), although the interval between images is represented by the necessary image interval (Δ) in FIG. 15(*a*) and FIG. 15(*b*).

(Embodiment 4)

The present embodiment has been achieved with an object to improve the image forming speed in single-sided image forming, in which the supply interval of transfer materials in the course of forming images on one side of a transfer material continuously is set to be not more than a half of the supply interval of the transfer materials in the course of forming images on both sides of the transfer material continuously.

Figure 16:
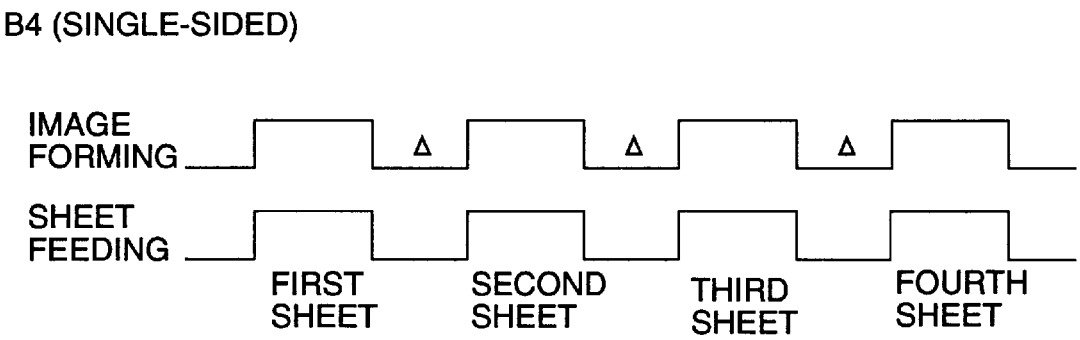
FIG. 16 is an illustration showing the relation between image forming and sheet-feeding timing in Embodiment 4.

An illustration of the present embodiment shown in FIG. 16 is one showing the relation between image forming to form single-sided images in B4 size continuously with an image forming apparatus wherein a length of intermediate transfer body 14*a* is the sum of the length of A3 size and the necessary interval between images (Δ) as in FIGS. 15(*a*) –FIG. 15(*d*) and sheet-feeding timing, and when comparing the foregoing with an example in the prior art in FIG. 15(*d*), an improvement of the image forming speed in the invention can be recognized.

As explained already, the image forming interval for the reverse side image and the obverse side image which is formed after the reverse side image in the course of double-sided image forming needs to be the same as a length of one turn of the intermediate transfer body 14*a* independently of the image size. However, the image forming interval for single-sided image forming is not restricted by the intermediate transfer body 14*a*. Therefore, the image forming interval can be narrowed to follow the image size. Namely, in this case, it is possible to narrow the interval between images to the level of necessary interval between images (Δ), and the supply interval of transfer materials in the course of single-sided image forming can be made to be narrower than a half of the supply interval of transfer materials in the course of double-sided image forming.

In the past, an image forming interval has been the same for all cases such as single-sided image forming for B4 size, double-sided image forming for B4 size, single-sided image forming for A3 size and double-sided image forming for A3 size, and the supply interval for transfer materials in single-sided image forming has been a half of the supply interval for transfer materials in double-sided image forming, independently of an image size. In the invention, however, when conducting single-sided image forming for B4 size, for example, the supply interval for transfer materials can be made to be narrower than a half of the supply interval in the case of double-sided image forming, which results in an improvement of the image forming speed.

(Embodiment 5)

The present embodiment has been achieved with an object to improve the image forming speed in double-sided image forming, in which the time interval from the start of forming of toner images to be transferred onto the obverse side of a transfer material to the start of forming of toner images to be transferred onto the reverse side of the transfer material is set to be not more than the time interval from the start of forming of toner images to be transferred onto the reverse side of the transfer material to the start of forming of toner images to be transferred onto the obverse side of the transfer material.

Figure 17:
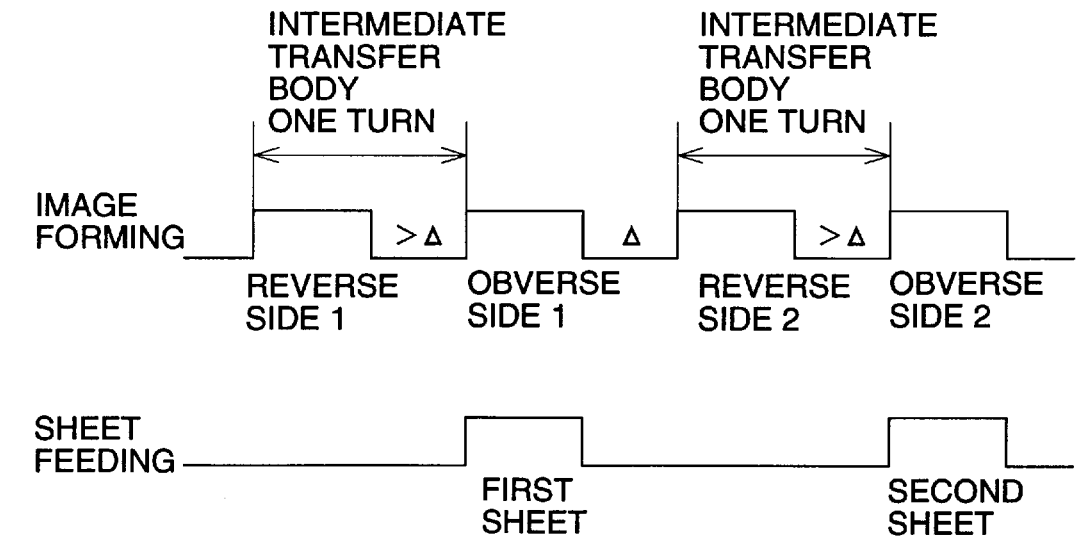
FIG. 17 is an illustration showing the relation between image forming and sheet-feeding timing in Embodiment 5.

An illustration of the present embodiment shown in FIG. 17 is one showing the relation between image forming to form double-sided images in B4 size continuously with an image forming apparatus wherein a length of intermediate transfer body 14*a* is the sum of the length of A3 size and the necessary interval between images (Δ) as in FIGS. 15(*a*) –15(*d*) and sheet-feeding timing, and when comparing the foregoing with an example in the prior art in FIG. 15(*c*), an improvement of the image forming speed in the invention can be recognized.

As explained already, the image forming interval for the reverse side image and the obverse side image which is formed after the reverse side image in the course of double-sided image forming needs to be the same as a length of one turn of the intermediate transfer body 14*a* independently of the image size. However, the image forming interval from the obverse side image to the following reverse side image is not restricted by the intermediate transfer body 14*a*. Therefore, the image forming interval can be narrowed to follow the image size. Namely, in this case, it is possible to narrow the interval between images to the level of necessary interval between images (Δ). For example, when forming double-sided images in B4 size, the image forming interval from the obverse side image to the subsequent reverse side image can be made to be narrower than that in the case of forming double-sided images in A3 size.

(Embodiment 6)

The present embodiment has been achieved with an object to improve the image forming speed in image forming when forming images continuously on both sides of a transfer material while making the second image carrying means to carry toner images equivalent to plural sheets of transfer materials, wherein the toner image forming interval for forming on the first image carrying means continuously the toner images to be carried on the second image carrying means is set to be not more than the value obtained by dividing the rotating cycle of the second image carrying means with the number of toner images to be carried on the second image carrying means.

Figure 18A:
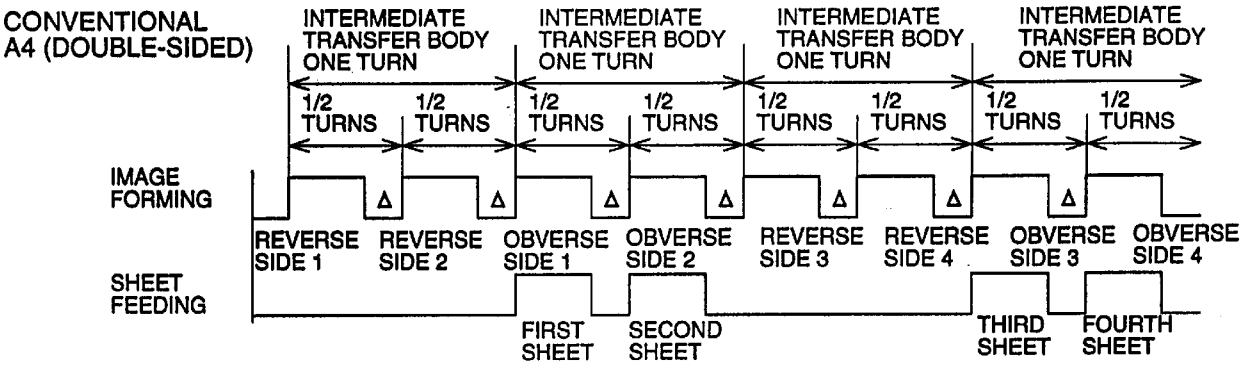
FIG. 18(a) PRIOR ART
FIGS. 18(*a*)–18(*c*) are represents illustrations each showing the relation between image forming and sheet-feeding timing in the conventional examples or in Embodiment 6.
Figure 18B:
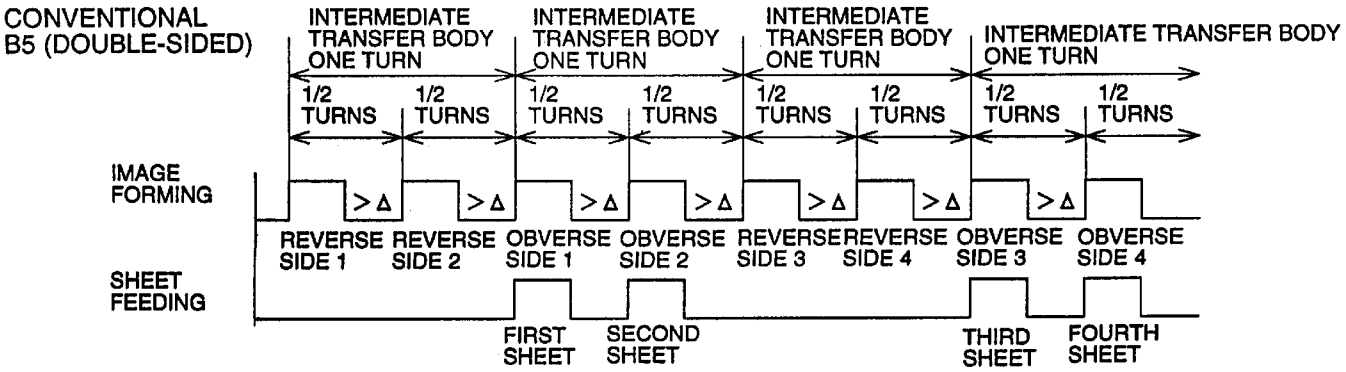
FIG. 18(b) PRIOR ART
Figure 18C:
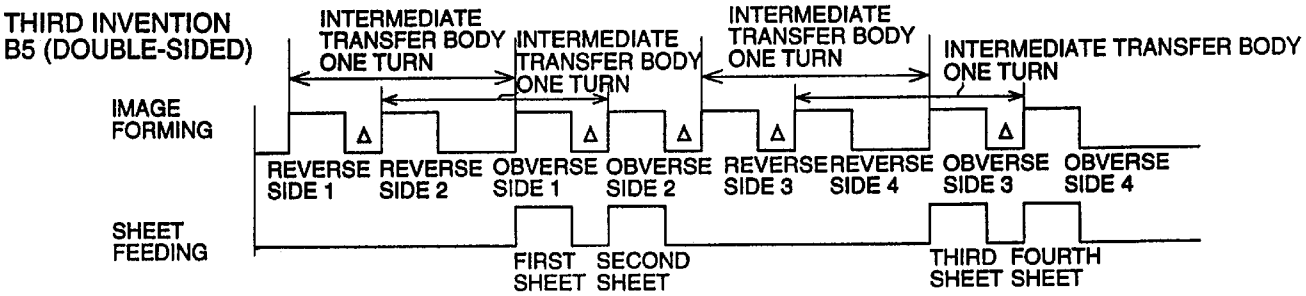

In FIGS. 18(*a*) and 18(*b*) and (8) show respectively the conventional image forming and sheet-feeding timing, and FIG. 18(*c*) shows the present embodiment. FIGS. 18(*a*)–18(*c*) each show the state wherein images are formed continuously on both sides of a transfer material while the second image carrying means carries toner images equivalent to two sheets of transfer materials. However, the number of the transfer material sheets is not limited to two in the invention. In the image forming apparatus used in this case, a length (circumferential length) of intermediate transfer body 14*a* is set to the length which is obtained by doubling the sum of a length of A4 size and necessary interval between images (Δ). In this case, the image forming speed is much faster compared with image forming in which images in A4 size are formed on intermediate transfer body 14*a* one image by one image. In the invention, however, even for B5 size which is smaller than A4 size, the image forming speed which used to be the same as that for others has been improved.

When forming two A4 size images on conventional intermediate transfer body 14*a* shown in FIG. 18(*a*), the image forming interval for reverse side images or obverse side images which are formed continuously is made to coincide with a half turns of the intermediate transfer body 14*a*. Further, even in the case of forming two B5 size images on the intermediate transfer body 14*a*, the image forming interval for reverse side images or obverse side images which are formed continuously is made to coincide with a half turns of the intermediate transfer body 14*a* as in the case of A4 size, from the viewpoint of easy timing control shown in FIG. 18(*b*). Therefore, the image forming interval in image forming for B5 size is broader than is needed. Namely, the interval between images is always broader than the necessary interval between images (>Δ).

In the present embodiment, the image forming interval from the reverse side image to the obverse side image is required to coincide with one turn of intermediate transfer body 14*a* independently of an image size, for each of the first or second sheet, as shown in FIG. 18(*c*). However, the image forming interval from the first sheet to the second sheet can be narrowed in accordance with an image size because there is no restriction from the intermediate transfer body 14*a*. Namely, the interval between images from the first sheet to the second sheet can be set to the necessary interval between images (Δ), and the image forming interval from the first sheet to the second sheet in forming double-sided images in B5 size can be set narrower than that in forming double-sided images in A4 size as shown in FIG. 18(*c*).

In Embodiment 4–Embodiment 6 explained above, the image forming speed is improved by forming the common image forming intervals which comply with each image condition as shown in the following table in the invention.

TABLE 1

| Image forming interval | Conventional | The invention |
|---|---|---|
| (Single-sided image forming)<br>Start writing the first sheet → | Equivalent to one turn of intermediate transfer body | Sheet size + Necessary interval between images |

TABLE 1-continued

| Image forming interval | Conventional | The invention |
|---|---|---|
| Start writing the second sheet<br>(Double-sided image forming)<br>Start writing reverse side →<br>Start writing obverse side<br>Start writing obverse side →<br>Start writing following reverse side | Equivalent to one turn of intermediate transfer body<br>Equivalent to one turn of intermediate transfer body | Equivalent to one turn of intermediate transfer body<br>Sheet size + Necessary interval between images |
| (Images for plural sheets on intermediate transfer body)<br>Start writing reverse side →<br>Start writing following reverse side<br>Start writing reverse side →<br>Start writing obverse side<br>Start writing last obverse side →<br>Start writing following reverse side | (Equivalent to one turn of intermediate transfer body)/ Number of image sheets<br>Equivalent to one turn of intermediate transfer body<br>(Equivalent to one turn of intermediate transfer body)/ Number of image sheets | Sheet size + Necessary interval between images<br>Equivalent to one turn of intermediate transfer body<br>Sheet size + Necessary interval between images |

Figure 14:
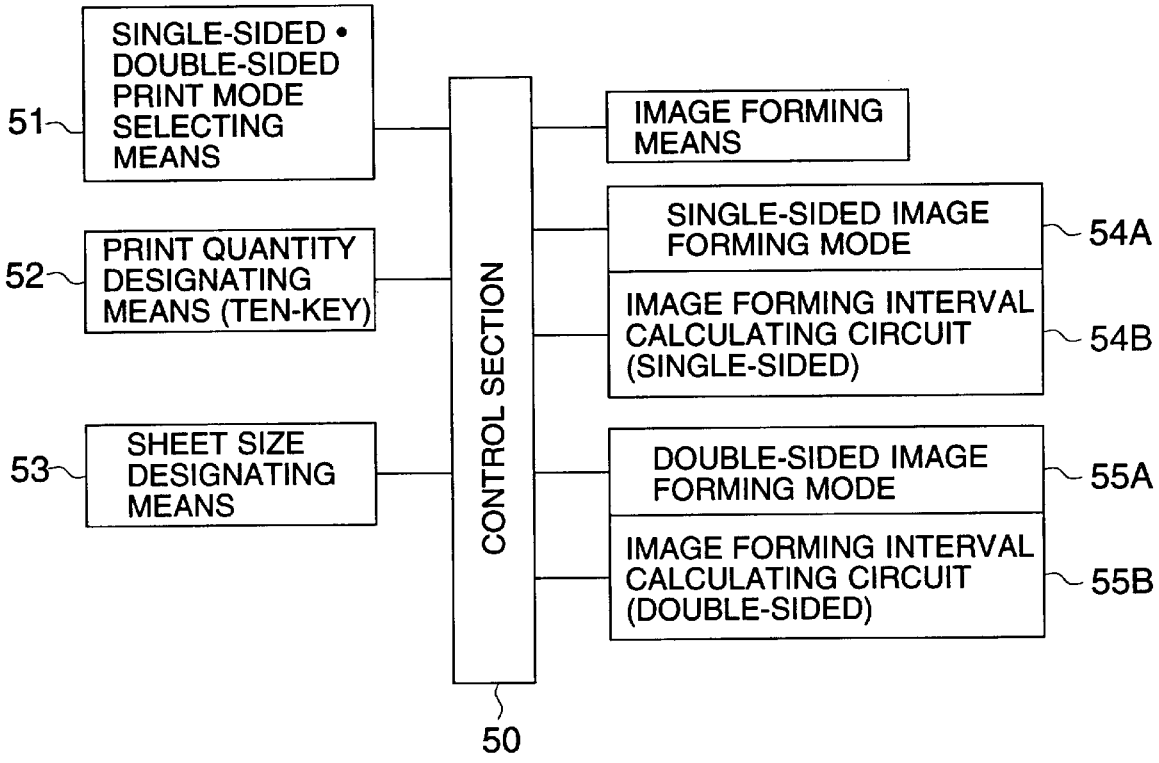
FIG. 14 is a block diagram of a control system for an image forming apparatus of the invention.
Figure 15A:
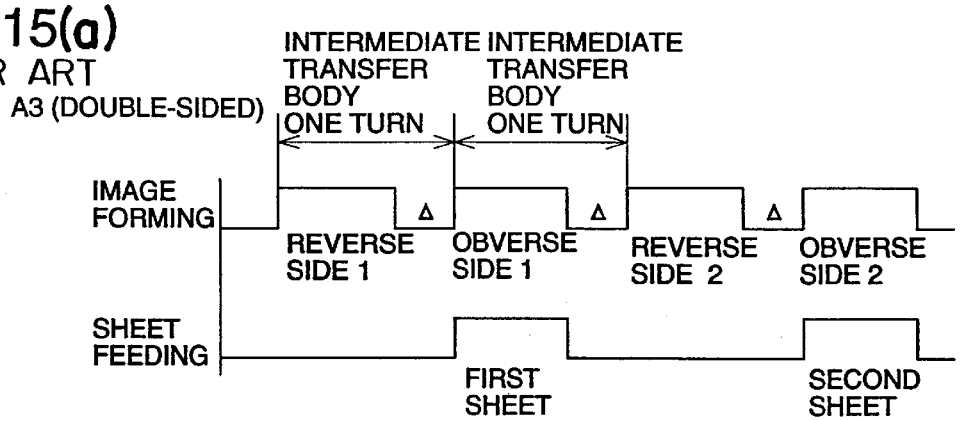
FIG. 15(a) PRIOR ART
FIGS. 15(*a*)–15(*d*) are represents illustrations each showing the relation between image forming and sheet-feeding timing in the past.
Figure 15B:
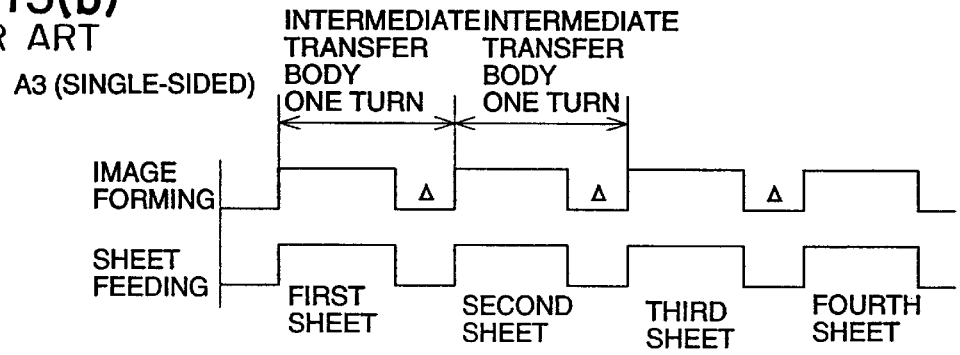
FIG. 15(b) PRIOR ART
Figure 15C:
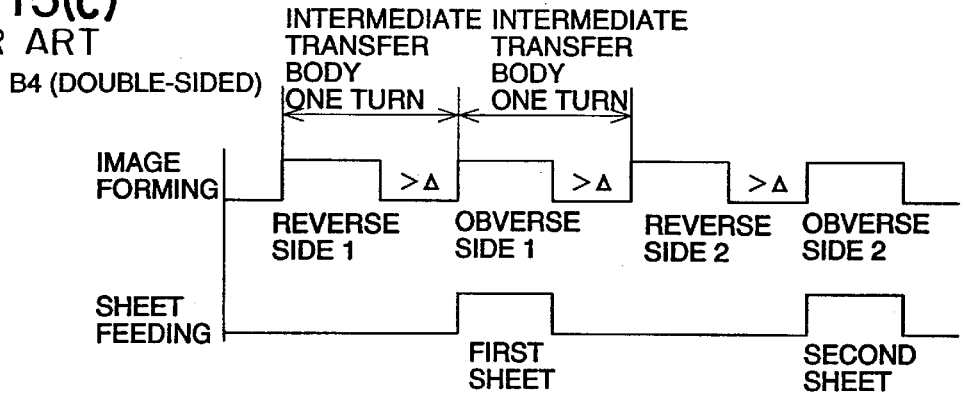
FIG. 15(c) PRIOR ART
Figure 15D:
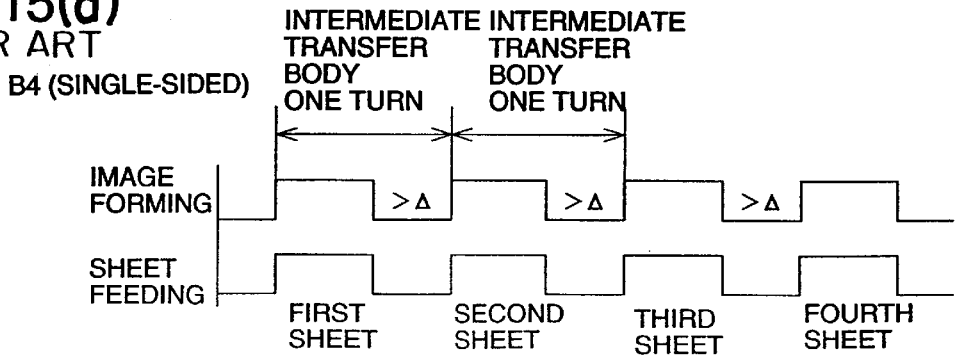
FIG. 15(d) PRIOR ART

FIG. 14 shows a control block diagram for continuous image forming in the invention. In control section 50, the image forming interval for continuous image forming resulted from the table stated above is calculated by image forming interval calculating circuits 54B and 55B from the number of prints (52), sheet size (53), a circumferential length of intermediate transfer body 14*a* in the apparatus main body and an interval between images established in advance, depending on single-sided image forming or double-sided image forming whichever determined by single-sided/double-sided print mode selecting means 51. In the control section 50, by doing image forming under single-sided image forming mode 54A or under double-sided image forming mode 55A based on the results of the calculation, the image forming speed can easily be improved.

The present invention is represented by an image forming apparatus having therein a first image carrying means which carries toner images formed by a toner image forming means, a second image carrying means which carries toner images which had been carried by the first image carrying means and have been transferred onto the second image carrying means, a first transfer means which transfers toner images carried by the first image carrying means onto the second image carrying means or onto the obverse side of a transfer material, a second transfer means which transfers toner images carried by the second image carrying means onto the reverse side of the transfer material, and a fixing means which fixes toner images transferred onto the transfer material, wherein the image forming speed is improved and processability is enhanced in the course of continuous image forming.

What is claimed is:

1. An apparatus for conducting a both-sided copy operation by which images are formed on both sides of a sheet, said apparatus comprising:

an image carrying member;

toner image forming means for forming toner images on the image carrying member;

an intermediate image carrying member onto which the toner image is transferred from the image carrying member;

a first transfer member for transferring the toner image from the first image carrying member to the intermediate image carrying member or to a first side of a sheet;

a second transfer member for transferring the toner image from the intermediate image carrying member to a second side of the sheet;

a fixing device having a pair of rotatable fixing rollers between which the sheet is nipped and heated so that the toner images on the first and second sides of the sheet are fixed simultaneously, said pair of rotatable fixing rollers comprising a first roller for contacting the toner image on the first side of the sheet and a second roller for contacting the toner image on the second side of the sheet, said second roller being a soft roller and including an elastic material, and each of the first roller and the second roller being provided with a heater and a temperature sensor;

detecting means for detecting a temperature of each of the first roller and the second roller; and control means for changing an image forming interval in accordance with a temperature of the second roller detected by the detecting means when the both-sided copy operation is continued.

2. The apparatus of claim 1, wherein when the detecting means detects a temperature change of the first and second rollers which is larger than a permissible range, the control means increases the image forming interval.

3. The apparatus of claim 1, wherein the first roller is a hard roller.

4. The apparatus of claim 1, wherein when the fixing device fixes the toner image on the second side of the sheet, the control means changes the image forming interval in accordance with the temperature of the second roller detected by the detecting means.

5. The apparatus of claim 1, wherein when the fixing means does not fix the toner image on the second side of the sheet, the control means does not change the image forming interval.

6. The apparatus of claim 1, wherein when a material of the sheet has a heat capacity larger than a standard value, the control means increases the image forming interval.

7. The apparatus of claim 1, wherein when a size of the sheet is larger than a standard size, the control means increases the image forming interval.

8. The apparatus of claim 1, wherein an interval for supplying sheets in a one side continuous image forming mode is set to be a half or less than an interval for supplying sheets in a both side continuous image forming mode.

9. The apparatus of claim 1, wherein a heat conductivity of the first roller is larger than a heat conductivity of the second roller.

10. The apparatus of claim 1, wherein when toner images are formed continuously on both sides of sheets, a time interval from a start of forming a toner image to be transferred onto the first side of a sheet to a start of forming a toner image to be transferred onto the second side of the sheet is set to be not more than a time interval from a start of forming a toner image to be transferred onto the second side of the sheet to a start of forming toner images to be transferred onto the first side of the sheet.

11. The apparatus of claim 1, wherein, when toner images are formed continuously on both sides of sheets while the intermediate image carrying member carries toner images corresponding to plural sheets, a toner image forming interval in a case of continuously forming toner images on the image carrying member which are carried by the intermediate image carrying member is set to be not more than a value obtained by dividing a rotation cycle of the intermediate image carrying member by a number of toner images to be carried by the intermediate image carrying member.

12. An apparatus for forming an image, comprising:

an image carrying member;

toner image forming means for forming toner images on the image carrying member;

an intermediate image carrying member onto which the toner image is transferred from the image carrying member;

a first transfer member for transferring the toner image from the first image carrying member to the intermediate image carrying member or to a first side of a sheet;

a second transfer member for transferring the toner image from the intermediate image carrying member to a second side of the sheet;

a fixing device including a heater and a pair of rotatable fixing members between which the sheet is nipped and heated so that the toner images on the first and second sides of the sheet are fixed;

detecting means for detecting at least one of a temperature of the fixing members, a material of the sheet and a size of the sheet; and control means for changing an image forming interval in accordance with at least one of the temperature of the fixing members, the material of the sheet and the size of the sheet detected by the detecting means;

wherein, when toner images are formed continuously on both sides of sheets while the intermediate image carrying member carries toner images corresponding to plural sheets, a toner image forming interval in a case of continuously forming toner images on the image carrying member which are carried by the intermediate image carrying member is set to be not more than a value obtained by dividing a rotation cycle of the intermediate image carrying member by a number of toner images to be carried by the intermediate image carrying member.

* * * * *